US010794130B2

(12) United States Patent
Johnson et al.

(10) Patent No.: US 10,794,130 B2
(45) Date of Patent: Oct. 6, 2020

(54) CONTINUOUS CIRCULATION SUB CONNECTION SYSTEM

(71) Applicants: Halliburton Energy Services, Inc., Houston, TX (US); ENI, S.P.A., Rome (IT)

(72) Inventors: Rachel Lynn Johnson, Dallas, TX (US); Alain J. Belanger, Hilton Beach, CA (US); Aurelio Bottino, Ortona (IT); Gianmaria Leccacorvi, Castell'Arquato (IT); Michael Don Lewis, Dallas, TX (US)

( * ) Notice: Subject to any disclaimer, the term of this patent is extended or adjusted under 35 U.S.C. 154(b) by 0 days.

(21) Appl. No.: 15/736,487

(22) PCT Filed: Jul. 29, 2015

(86) PCT No.: PCT/IT2015/000190
§ 371 (c)(1),
(2) Date: Dec. 14, 2017

(87) PCT Pub. No.: WO2017/017700
PCT Pub. Date: Feb. 2, 2017

(65) Prior Publication Data

US 2018/0202247 A1 Jul. 19, 2018

(51) Int. Cl.
*E21B 19/16* (2006.01)
*E21B 21/08* (2006.01)
*E21B 21/10* (2006.01)

(52) U.S. Cl.
CPC ..... *E21B 21/08* (2013.01); *E21B 19/161* (2013.01); *E21B 21/106* (2013.01)

(58) Field of Classification Search
CPC ..... E21B 21/08
(Continued)

(56) References Cited

U.S. PATENT DOCUMENTS 8,016,033 B2 9/2011 Iblings et al.
2009/0025930 A1 1/2009 Iblings et al.
(Continued)

FOREIGN PATENT DOCUMENTS

WO WO 2015/047418 A1 4/2015

OTHER PUBLICATIONS

International Search Report and The Written Opinion of the International Search Authority, or the Declaration, dated May 6, 2016, PCT/IT2015/000190, 15 pages, ISA/EP.

*Primary Examiner* — Taras P Bemko

(57) ABSTRACT

A continuous circulation system and an connection assembly for establishing a threaded fluid seal to a side port of a continuous circulating sub, according an embodiment, is disclosed, having independently rotatable and movable first and second first engagement mechanisms. The first engagement mechanism may include first and second wrenches for engaging a pressure tap, checking pressure, removing and reinstalling a safety plug. The second engagement mechanism may include an adapter pipe for creating a threaded seal with the side port thereby allowing reliable high-pressure flow. The connection assembly automates the steps of checking pressure within the sub between the radial valve and safety plug, removing the safety plug, screwing the threaded adapter pipe into the side port, providing a flow path for drilling fluid, disengaging the threaded adapter pipe, replacing the safety plug and returning the continuous circulation sub to its original operational state.

15 Claims, 20 Drawing Sheets

(58) Field of Classification Search
USPC ..... 175/25
See application file for complete search history.

(56) References Cited

U.S. PATENT DOCUMENTS

| | | | | |
|---|---|---|---|---|
| 2009/0242817 | A1 | 10/2009 | Strazhgorodskiy | |
| 2013/0112428 | A1 | 5/2013 | Weir et al. | |
| 2014/0202767 | A1 | 7/2014 | Feasey | |
| 2017/0342789 | A1* | 11/2017 | Girola | E21B 21/106 |

* cited by examiner

CONTINUOUS CIRCULATION SUB CONNECTION SYSTEM

PRIORITY

The present application is a U.S. National Stage patent application of International Patent Application No. PCT/IT2015/000190, filed on Jul. 29, 2015, the benefit of which is claimed and the disclosure of which is incorporated herein by reference in its entirety.

TECHNICAL FIELD

The present disclosure relates generally to operations performed and equipment used in conjunction with a subterranean well, such as a well for recovery of oil, gas, or minerals. In particular, the present disclosure relates to continuous circulation systems for maintaining drilling fluid flow while making or breaking joints of drill pipe within a drill string.

BACKGROUND

In the drilling of oil and gas wells, drilling fluid is conventionally pumped through a drill string via a connection at the top of the drill string in order to circulate the drilling fluid through the drill string, bottom hole assembly, and wellbore during drilling operations. The drilling fluid may be pumped to a top drive or fluid swivel, which is connected to the top of the drill string. As drilling progresses, drill pipe (e.g., as 30 ft. individual pipe lengths or 90 ft. stands consisting of three pipe lengths) is added between the top drive or fluid swivel and the drill string in order to extend the drill string into the formation. Conventionally, drill string connections are made by shutting down the mud pumps used to circulate the drilling fluid, disconnecting the top drive or fluid swivel from the drill string, and connecting a stand or pipe section to the drill string. With the drill string connection thus made, the top drive or fluid swivel may be reconnected to the new stand or pipe section and the mud pumps restarted to recommence circulation of drilling fluid. Drilling operations may then continue.

This period of time during which drilling fluid circulation is interrupted is a critical period. In addition to the time-consuming and disruptive practice of starting and stopping circulation, undesirable effects caused by circulation interruption may occur: A loss of equivalent circulating density—the effective density exerted by a circulating fluid against the formation taking into account fluid density, flow friction and pressure losses—may result in lowered bottom-hole pressure, which may allow uncontrolled ingress of formation fluids in the wellbore, i.e., a "kick." Drill cuttings may also settle to the bottom of the wellbore, which may lead to mechanical sticking of the bottom hole assembly, difficulty in re-establishing drilling fluid circulation, and lost time in clearing the cuttings from the wellbore.

Accordingly, continuous circulation systems have been developed for use in drilling operations to maintain a flow of drilling fluid through the drill string and wellbore while making and breaking drill string connections. One type of continuous circulation system includes a large mechanical structure forming a flow containment vessel that surrounds and provides a rotatable seal against the outer surfaces of a drill pipe section or a top drive quill above the pipe joint to be made up (or broken out) and to the drill string below the joint.

To make up a joint, flow is provided to the containment vessel and top drive simultaneously. The system disconnects the top drive quill from the top of the drill string. Once disconnected, flow from the containment vessel enters the top of the drill string, flow to the top drive is ceased, and a flow barrier located within the containment vessel between the two pipes, similar to that of a blind ram assembly, is shut. The top drive quill may then be removed from the upper portion of the containment vessel while continuous flow is maintained below the flow barrier. A drill pipe section is then added to the top drive quill, and the lower end of the drill pipe section is inserted into the containment vessel. Flow is then reinitiated to the top drive, the flow barrier opened, and the lower end of the pipe section is threaded into the upper of the drill string. Flow is then secured to the containment vessel. The large size and heavy weight of this type of continuous circulation system may limit installation capability on smaller rigs. Moreover, circulation pressures may be limited due to elastomeric seals against the outer surfaces of drill pipe.

BRIEF DESCRIPTION OF THE DRAWINGS

Embodiments are described in detail hereinafter with reference to the accompanying figures, in which.

DETAILED DESCRIPTION

Figure 1:
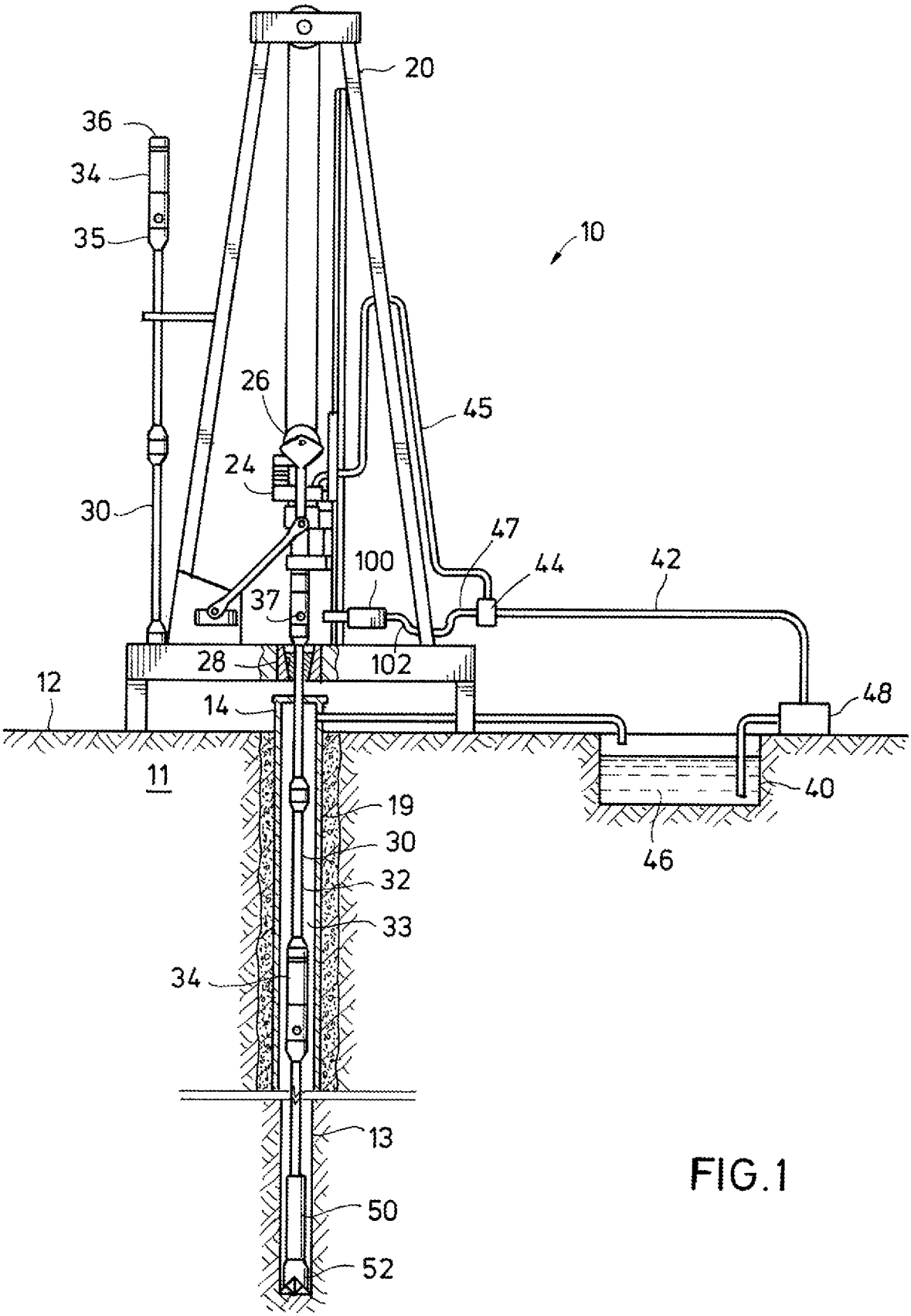
FIG. 1 is an elevation view in partial cross-section of a continuous circulation drilling system according to an embodiment, showing a rig carrying a drill string including a number of continuous circulation subs intervaled between drill pipe stands and a continuous circulation sub connection assembly.

The present disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures.

In the disclosure, like numerals may be employed to designate like parts throughout. Various items of equipment, such as fasteners, fittings, etc., may be omitted to simplify the description. However, routineers in the art will realize that such conventional equipment can be employed as desired.

A type of continuous circulation system uses continuous circulation subs that are connected to the top end of a drill pipe length or stand to be added to the drill string. A continuous circulation sub may be used at each joint or at various intervals as desired. Continuous circulation subs provide for pressure containment and flow diversion during the connection process. Typically, continuous circulation subs have a side port which allows fluid flow into the drill string and a flow barrier that prevents flow from exiting the top of the sub, thereby allowing a drill pipe length or stand to be added to the top of the sub while flow is maintained through the side port.

Various types of continuous circulation subs exist, each with unique characteristics and distinct differences in enabling continuous circulation connections. One notable difference among the various types of continuous circulation subs is the manner in which the flow barrier is created. Continuous circulation subs may have ball valves, poppet valves, sliding sleeves, and/or balls that are pumped onto seats. The valves may be biased or unbiased, and operated by flow pressure differential, or by manual activation. Continuous circulation subs may also have various arrangements for accessing and establishing flow at the side port.

Some embodiments of continuous circulation subs rely on a collar disposed at least partially around the perimeter of the sub so as to define an exterior flow path along the exterior of the sub. The collar may be sealed about the surface of the sub using elastomeric seals. Radial flow may be initiated into the sub through the collar along the exterior flow path. Other embodiments of continuous circulation subs rely on elastomeric seals within the side port profile. Pressure and the flow is contained within the elastomer contact area with the sub's outer body or side port face. Elastomeric seals may facilitate rapid connection or automated/semi-automated connection to the side entry port of a continuous circulation sub, but elastomeric seals may be damaged when exposed to the harsh drilling environment and may limit the available fluid circulation pressure that may be used. In other embodiments of continuous circulation sub systems, there are no elastomeric seals and the risk of damage may be reduced and/or eliminated while the allowable fluid circulation pressure may be increased.

FIG. 1 is an elevation view in partial cross-section of a continuous circulation drilling system 10 according to an embodiment. System 10 may include a derrick or rig 20, which may be located on land, as illustrated, or atop an offshore platform, semi-submersible, drill ship, or any other platform capable of forming a wellbore 13 through one or more downhole formations 11. Drilling system 10 may be used in vertical wells, non-vertical or deviated wells, multilateral wells, offshore wells, etc.

Drilling system 10 may include a top drive 24, a hoist 26, and other equipment necessary for drilling wellbore 13. In addition to or in place of top drive 24, a rotary table 28 may be provided. Drilling rig 20 may be located generally above a well head 14, which in the case of an offshore location is located at the sea bed and may be connected to drilling rig 20 via a riser (not illustrated).

Rig 20 may be used to carry a drill string 32, assembled from individual lengths or stands of connected lengths of tubulars 30, which may be run all, or partly, into wellbore 13 (which may be completed or in the process of being drilled). Drill string 32 may include standard drill pipe, heavy-wall drill pipe, drill collars, coiled tubing, and combinations thereof, for example. Wellbore 13 may be all or partially lined with casing 19 along its length. According to one or more embodiments, drill string 32 may include one or more continuous circulation subs 34 along its length, which may be intervaled between individual lengths or stands of drill pipe 30, for example.

The lower end of drill string 32 may include a bottom hole assembly 50, which may carry at a distal end a rotary drill bit 52. Bottom hole assembly 50 may include one or more drill collars, stabilizers, reamers, a downhole mud motor, rotary steerable device and various other tools, such as those that provide logging or measurement data and other information from the bottom of wellbore 13. Measurement data and other information may be communicated from bottom hole assembly 50 using measurement while drilling techniques and converted to electrical signals at the well surface 12 to, among other things, monitor the performance of drilling string 32, bottom hole assembly 50, and associated rotary drill bit 52.

The interior of drill string 32 defines an axially extending conduit. An annulus 33 is defined between drill string 32 and the wall of wellbore 13. During drilling operations, a mud pump 48 may provide a drilling fluid 46 or other well treatment fluid such as weighted drilling mud, a cement slurry, a displacement fluid, a completion fluid, a stimulation fluid, a gravel pack fluid, and the like, from a mud pit 40, through the interior of drill string 32, through bottom hole assembly 50, to exit through nozzles within drill bit 52. The drilling fluid 46 may then mix with formation cuttings and other downhole fluids and debris. Annulus 33 may provide a flow path for the drilling fluid to be returned to mud pit 40 at surface 12. Various types of screens, filters and/or centrifuges (not shown) may be provided to remove formation cuttings and other downhole debris prior to returning drilling fluid to recirculation by mud pump 48.

Figure 3:
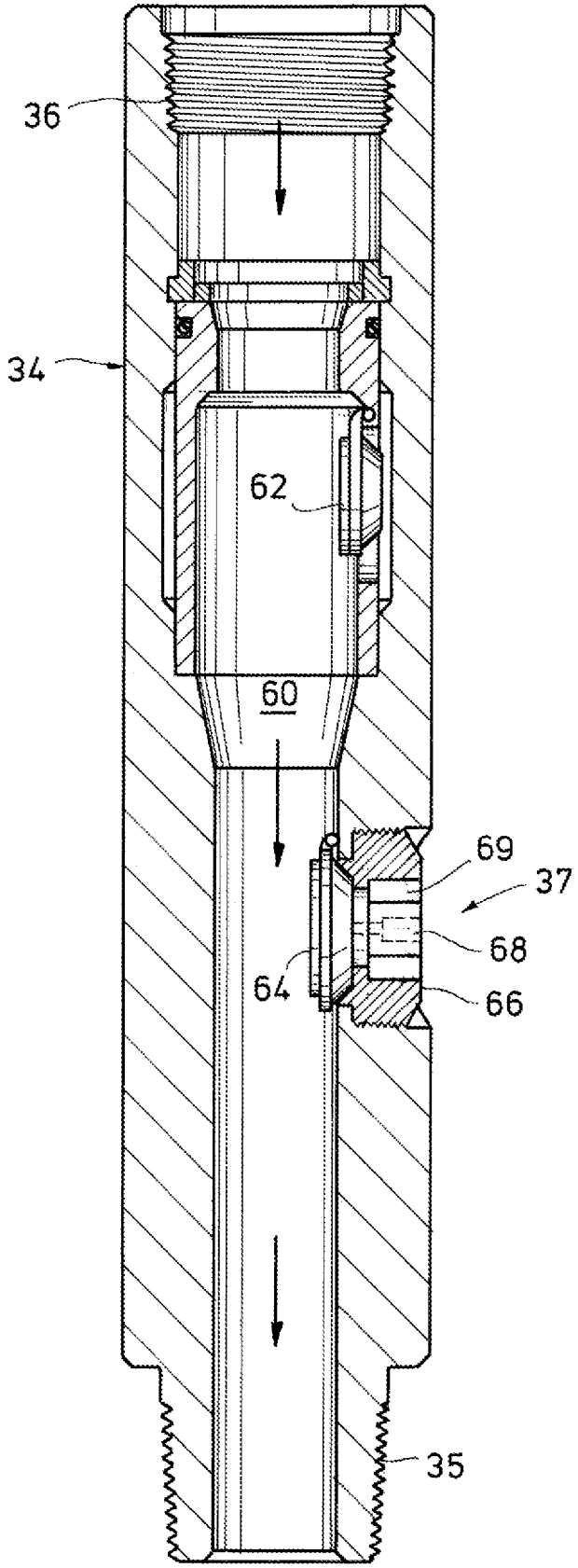
FIG. 3 is a partial axial cross-section of a continuous circulation sub of FIG. 1 according to an embodiment, showing the continuous circulation sub operating in an axial flow state with flow entering the sub through an upper connector.

Referring to FIGS. 1 and 3, continuous circulation subs 34 allow the circulation of drilling fluid 46 through wellbore 13 to continue without interruption during all the operational steps necessary for making or breaking connections of drill string 32 at the rig floor. According to one or more embodiments, each continuous circulation sub 34 includes a tubular body with pin and box connectors 35, 36 at opposite ends for connection along drill string 32. However, other suitable connector types may be used appropriate for the drill string 32 along which continuous circulation subs 34 are connected. Continuous circulation sub 34 may be a unitary sub, or an assembly of discreet sub components.

In particular, continuous circulation drilling system 10 may employ an individual continuous circulation sub 34 connected atop each drill pipe stand 30 as the stand is being made up to or removed from drill string 32, as discussed hereinafter. The tubular body of continuous circulation sub 34 defines an axial flow path 60 between connectors 35, 36. An axial flow valve 62 is disposed within sub 34, which acts as a one-way check valve that allows flow in the downhole direction only. In some embodiments, axial valve 62 may be a swing check flapper valve, although other types of valves may be used as appropriate.

A threaded side port 37 is formed through the wall of continuous circulation sub 34 so as to intersect axial flow path 60. A radial flow valve 64 is disposed within sub 34 downhole of the axial valve. The radial valve acts as a one-way check valve that allows flow only from side port 37 into axial flow path 60. In some embodiments, radial valve 64 may be a swing-check or flapper valve, although other types of valves may be used as appropriate. Axial and radial valves 62, 64 may be manually or automatically operable and may be independent or operably coupled. Threaded side port 37 may be formed directly within the tubular body of continuous circulation sub 34, as illustrated in FIG. 3, or threaded side port 37 may be formed within a separate, discrete radial body (not illustrated) that is connected to and forms a portion of continuous circulation sub 34.

In one or more embodiments, side port 37 has tapered female threads suitable for making an external high-pressure sealed connection. A safety plug 66, which may have tapered male threads that complement the female threads of side port 37, may be screwed into the exterior of side port 37. Safety plug 66 may include a socket 69 that allows safety plug 66 to be engaged and rotated for insertion and removal. Socket 69 may be hexagonal, although other torque-transmitting profiles may be used as appropriate. Safety plug 66 may also include a threaded pressure tap 68.

Continuous circulation drilling system 10 may operate to maintain continuous circulation as follows: As shown in FIGS. 1 and 3, during drilling operations drill string 32 is lowered into wellbore 13 via hoist 26 and rotated by top drive 24 or rotary table 28. Drilling fluid is supplied by mud pump 48 via a flow line 42, flow manifold 44, hose 45, and top drive 24 or a fluid swivel (not illustrated) to axial flow path 60 through top connector 36 of continuous circulation sub 34.

Axial valve 62 is open and radial valve 64 is shut. Fluid flows out bottom connector 35 into the interior of drill string 32.

Figure 2:
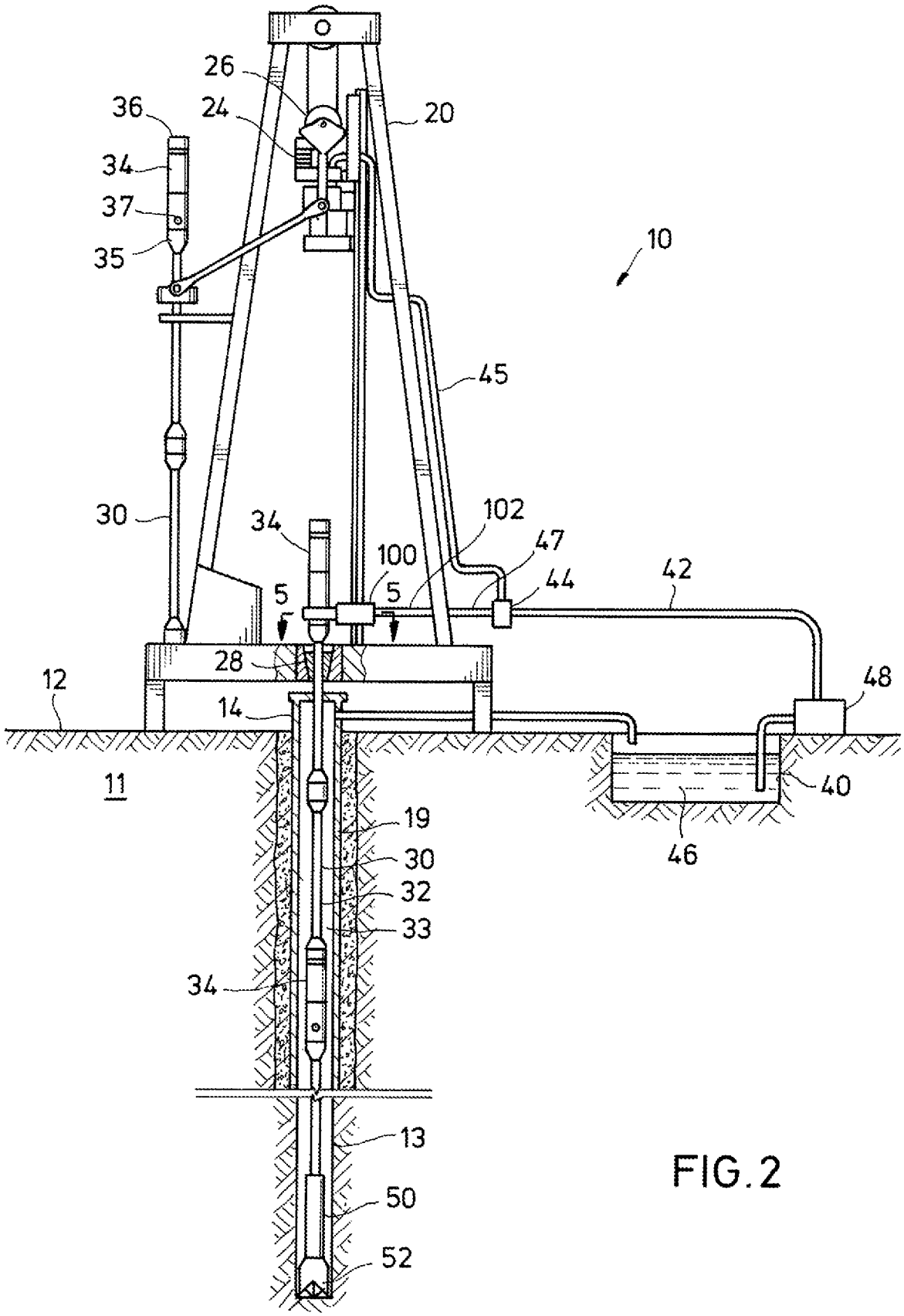
FIG. 2 is an elevation view in partial cross-section of the continuous circulation drilling system of FIG. 1, showing the continuous circulation sub connection assembly engaged with a side port of a continuous circulation sub at the rig floor.
Figure 4:
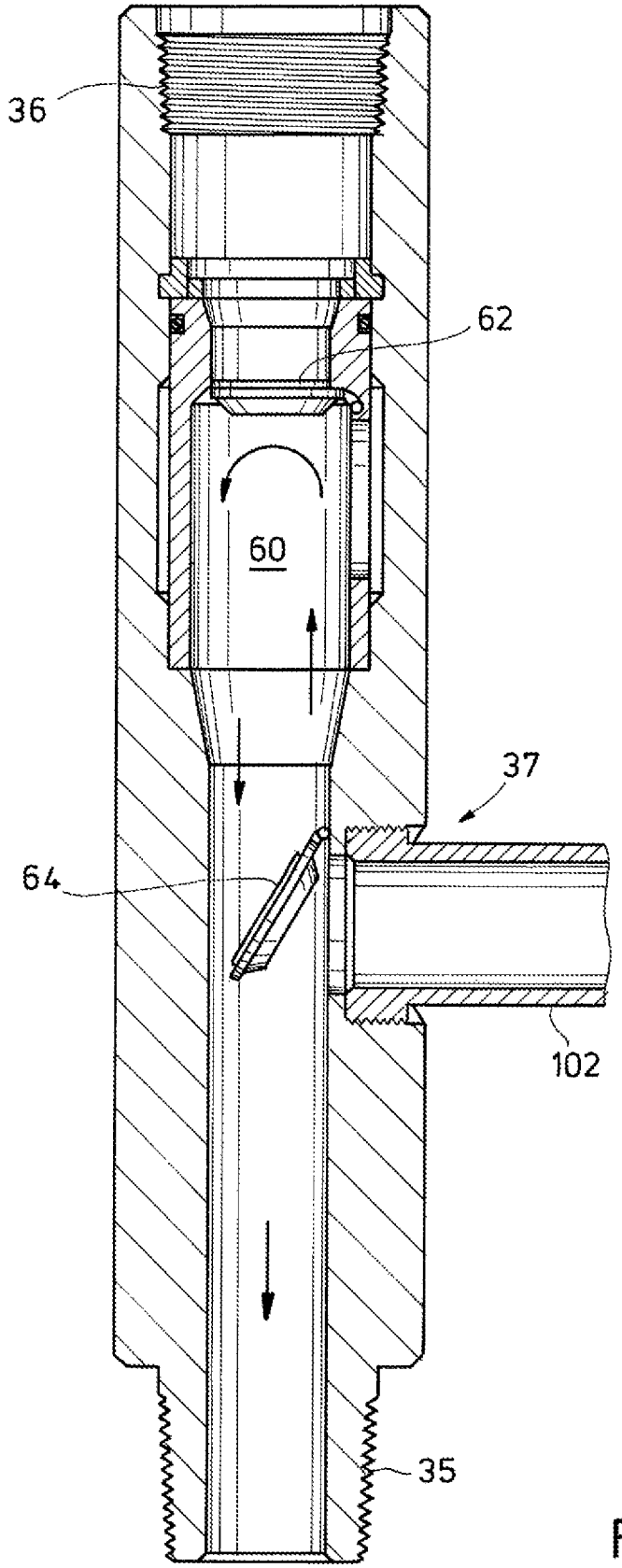
FIG. 4 is a partial axial cross-section of the continuous circulation sub of FIG. 3, showing flow entering through an adapter pipe threaded into a side port of the continuous circulation sub.

Lowering and rotating drill string 32 is temporarily ceased when continuous circulation sub 34 reaches the level of the drilling rig floor. Drill string may be held by slips within rotary table 28. At this point, as shown in FIGS. 2 and 4, a continuous circulation sub connection assembly 100 is connected about continuous circulation sub 34 at the elevation of side port 37. As described in greater detail below, continuous circulation sub connection assembly 100 may automatically or semi-automatically check, at pressure tap 68, the pressure within side port 37 between radial valve 64 and safety plug 66, remove safety plug 66 from side port 37, and screw an adapter pipe 102 into threaded side port 37. Flow manifold 44 may then be operated to divert drilling fluid flowing through hose 45 and connector 36 into axial flow path 60 of continuous circulation sub 34 to a hose 47 and adapter pipe 102 into side port 37 of continuous circulation sub 34. The pressure differential within continuous circulation sub 34 operates to shut the axial valve and open the radial valve within continuous circulation sub 34. That is, the flow of drilling fluid through side port 37 and radial valve 64 may be gradually increased as flow of drilling fluid through axial valve 62 is correspondingly gradually decreased until axial valve 62 is fully shut and all flow of drilling fluid occurs through side port 37.

With continuous flow thus established, top drive 28 or the fluid swivel (not illustrated) may be removed from the top of continuous circulation sub 34, and another drill pipe stand or length 30, topped with another continuous circulation sub 34, may be connected to drill string 32. Flow manifold 44 may then be operated to gradually divert drilling fluid 46 from side entry port 37 back to top drive 24 or the fluid swivel (not illustrated) to commence fluid flow into the top of the newly added stand 30. The pressure differential within lower continuous circulation sub 34 operates to open the axial valve and shut the radial valve within continuous circulation sub 34. When radial valve 64 is shut, continuous circulation sub connection assembly 100 may then automatically or semi-automatically unscrew adapter pipe 102 from side port 37 and replace the threaded safety plug within side port 37. Continuous circulation sub connection assembly 100 may then be removed from drill string 32, slips may be removed, and rotation and lowering of drill string 32 may be recommenced. This process is repeated as drilling progresses. This process may also be reversed when removing drill string 32 from wellbore 13.

When continuous circulation is required, a continuous circulation sub 34 may be pre-installed on the top of each drill pipe/drill stand 30 prior to attachment of the drill pipe stand or length 30 to the existing drill string 32. Accordingly, individual drill pipe stands/lengths 30 and continuous circulation subs 34 may alternate along the length, or a portion thereof, of drill string 32. According to one or more embodiments, continuous circulation sub 34 includes a tubular body having a short length. The short length of continuous circulation sub 34 minimizes the likelihood that height issues may arise that limit the maximum length of a stand 30 of drill pipe that can be handled at one time by rig 20 due to the addition of continuous circulation sub 34 to the stand.

Figure 5:
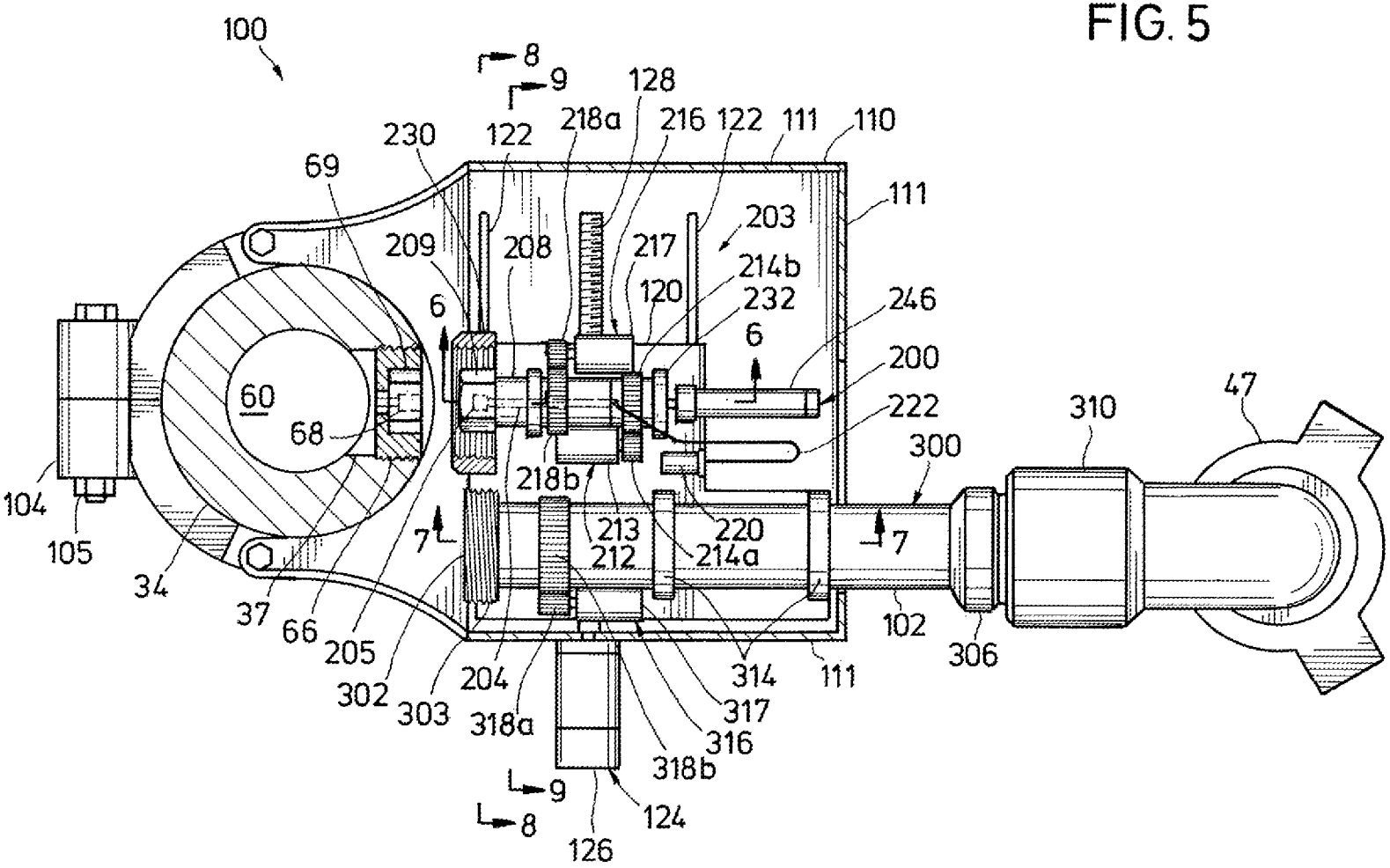
FIG. 5 is a cross-section taken along lines 5-5 of FIG. 2 of the continuous circulation sub connection assembly according to an embodiment, showing first and second engagement mechanisms carried upon a movable base for engagement with the side port of a continuous circulation sub.

FIG. 5 is a plan view in partial cross-section of continuous circulation sub connection assembly 100 according to an embodiment. Referring to FIG. 5, a hinged clamping assembly 104 may be provided for rapid engagement of continuous circulation sub connection assembly 100 about continuous circulation sub 34 adjacent side port 37. Clamping assembly 104 may extend fully or partially around the perimeter of continuous circulation sub 34 and be secured with a fastener 105. However, arrangements other than clamping assembly 104 may be used as appropriate to position continuous circulation sub connection assembly 100 adjacent or proximal to side port 37.

Figure 6:
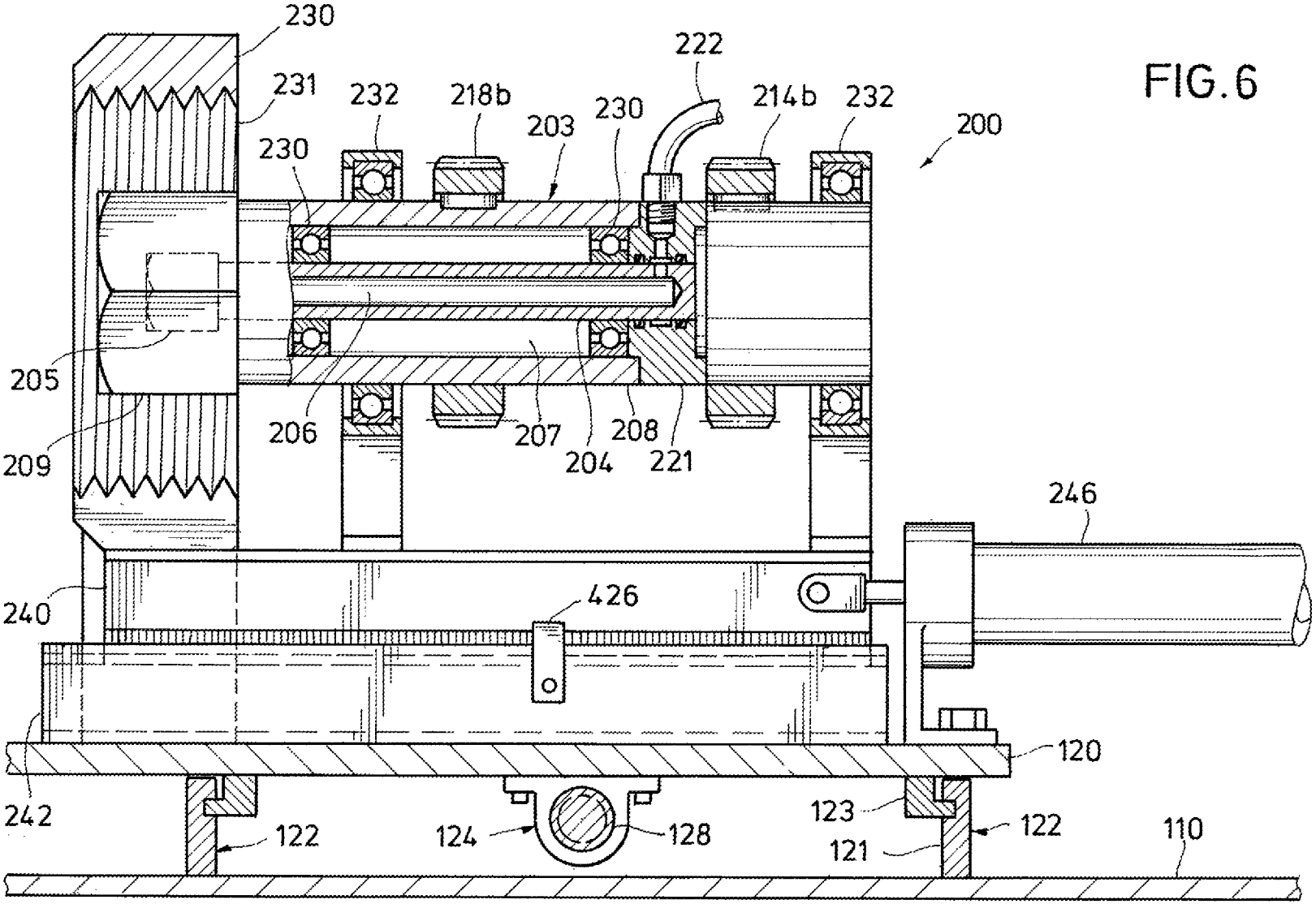
FIG. 6 is a partial cross-section taken along lines 6-6 of FIG. 5, showing details of the first engagement mechanism, including a coaxial tool assembly.

FIGS. 6-9 are partial cross-sections taken along lines 6-6, 7-7, 8-8, and 9-9 of FIG. 5, respectively. Referring to FIGS. 5-9, continuous circulation sub connection assembly 100 may include a tray 110, which is carried by clamping assembly 104. Tray 110 may include sidewalls 111 and a cover 112 (FIG. 6). Tray 110 may provide a barrier for spill prevention. Although not illustrated, continuous circulation sub connection assembly 100 may include a low pressure secondary seal provided by an elastomeric material placed in between the area of contact of continuous circulation sub 34 and continuous circulation sub connection assembly 100.

Tray 110 may support a movable base 120 upon ways 122. Ways 122 may be tracks, rails linear bearings, T-slots, or the like, arranged to slideably connect base 120 to tray 110. In the illustrated embodiment, ways 122 include elongate slotted tracks 121 attached to the upper side of tray 110 and elongate guides 123 attached to the underside of base 120. Guides 123 each have an elongate protruding finger that is slideably received within the mating slot of the corresponding track 121.

Ways 122 are oriented to move base 120 back and forth in a transverse direction so as to position either a first engagement mechanism 200 or second engagement mechanism 300 to radially align with side port 37 of continuous circulation sub 34 when positioned within clamping assembly 104. A base actuator assembly 124 is connected between tray 110 and base 120 to selectively position base 120 along ways 122. Base actuator assembly 124 may include a motor 126 and lead screw arrangement 128, although other suitable mechanisms, such as a rack and pinion mechanism, may be used as appropriate. Motor 126 may be a hydraulic motor, pneumatic motor, or electric motor, as appropriate.

Referring now to FIGS. 5, 6, 8 and 9, according to one or more embodiments, first engagement mechanism 200 includes a coaxial tool assembly 203 having a tubular inner wrench 204 located within a tubular outer wrench 208. Outer wrench 208 may define a hollow interior 207. Inner wrench 204 may define a hollow interior 206. Inner wrench 204 may be rotatively supported with respect to outer wrench 208 by bearings 230. Telescopic wrench mechanism 203 may be rotatively supported with respect to base 120 by bearings 232. However other suitable arrangements may be used as appropriate.

Inner wrench 204 and outer wrench 208 may be selectively rotated, clockwise or counterclockwise, independently of one another by actuator assemblies 212 and 216, respectively. Actuator assemblies 212, 216 may include motors 213, 217, respectively, which may be hydraulic, pneumatic, or electric. Motors 213, 217 may be operable to independently rotate inner and outer wrenches 204, 208 either counterclockwise or clockwise via pinions **214*a*, 218*a* and spur gears 214*b*, 218*b*, respectively. That is, spur gear 214*b* is rigidly attached about outer wrench 208 and is driven by motor 213 and pinion 214*a*. Likewise, spur gear 218*b* is rigidly attached about inner wrench 204 and is driven by motor 217 and pinion 218*a*. However, other drive arrangements, such as pulleys and belts or sprockets and chains, may be substituted for pinions and spur gears. Moreover, other arrangements for actuator assemblies 212, 216**, including direct drive arrangements, may be used as appropriate.

The connection end of inner wrench 204 includes a head 205, which has a torque-transmitting profile dimensioned for engagement with pressure tap 68. Head 205 and pressure tap 68 may have hexagonal torque-transmitting profiles, although other suitable torque-transmitting profiles may also be used. In one or more embodiments, as described in greater detail below with respect to FIGS. 15-18, by engaging inner wrench head 205 with pressure tap 68 and rotating inner wrench 204, pressure between the radial valve 64 (FIG. 3) and safety plug 66 may be communicated to a pressure sensing device 220 via a sealing fluid swivel assembly 221 and a tube 222. In one or more embodiments, pressure between the radial valve 64 (FIG. 3) and safety plug 66 may be communicated via interior 206 of inner wrench 204. The opposite end of inner wrench 204 may be fluidly coupled to pressure sensing device 220 via sealing fluid swivel assembly 221 and tube 222. In one or more embodiments, described below with respect to FIG. 19, pressure between the radial valve 64 (FIG. 3) and safety plug 66 may be communicated to pressure sensing device 220 via an annular region of interior 207 of outer wrench 208 external to inner wrench 204.

The connection end of outer wrench 208 includes a head 209, which has a torque-transmitting profile dimensioned for engagement with socket 69 formed in the exterior face of safety plug 66. Head 209 and socket 69 may be hexagonal, although other torque-transmitting profiles may be used as appropriate.

Telescopic wrench mechanism 203 and actuator assemblies 212, 216, may be carried on a cross-slide 240 that slideably engages ways 242 mounted atop base 120. Ways 242 may be tracks, rails linear bearings, T-slots, or the like, arranged to slideably connect cross-slide 240 to base 120. In the illustrated embodiment, ways 242 include elongate slotted tracks attached to the upper side of base 120. The lower surface of cross-slide 240 has elongate protruding fingers that are slideably received within the mating slots of the corresponding tracks. Cross-slide 240 may be moved in and out, i.e., in a radial direction with respect to continuous circulation sub 34, by a linear actuator 246. Linear actuator 246 is operatively coupled between cross-slide 240 and base 120. Linear actuator 246 may be a hydraulic or pneumatic cylinder, although other suitable mechanisms may be used, such as a lead screw or rack and pinion assembly.

According to one or more embodiments, continuous circulation sub connection assembly 100 may further include a safety cuff 230 having a partial circular internal surface with internal threads 231 dimensioned to receive safety plug 66. Internal threads 231 of safety cuff 230 may be, but are not necessarily, tapered. Safety cuff 230 may be fixed to base 120 or otherwise attached to base 120 so as to generally maintain a fixed distance, with limited play, with respect to continuous circulation sub 34. Limited play of about the axial distance of a single thread may be provided to facilitate thread engagement of safety plug 66 into safety cuff 230, as described in greater detail hereinafter.

Referring now to FIGS. 5 and 7-9, according to one or more embodiments, second engagement mechanism 300 includes adapter pipe 102. Adapter pipe 102 has a connection end 302 with male threads 303 that complement the female threads of side port 37 and female threads 231 of safety cuff 230. Male threads 303 of connection end 302 may be tapered for forming a high-pressure fluid seal with the female threads of side port 37. A distal end 306 of adapter pipe 102 may be fluidly connected to a hose 47 via a fluid swivel 310.

Adapter pipe 102 may be rotatively carried upon base 102 by bearings 314. Adapter pipe 102 may be selectively rotated, clockwise or counterclockwise, by an actuator assembly 316. Actuator assembly 316 may include a motor 317, which may be hydraulic, pneumatic, or electric, that rotates adapter pipe 102 via a pinion 318*a* and spur gear 318*b*. However, a belt with pulleys, a chain with sprockets, or the like may be used in place of gears. Moreover, other arrangements for actuator assembly 316, including direct drive, may be used as appropriate.

Adapter pipe 102, bearings 314, and actuator assembly 316 may be carried on a cross-slide 340 that slideably engages ways 342 mounted atop base 120. Ways 342 may be tracks, rails linear bearings, T-slots, or the like, arranged to slideably connect cross-slide 340 to base 120. In the illustrated embodiment, ways 342 include elongate slotted tracks attached to the upper side of base 120. Cross-slide 340 has elongate protruding fingers that are slideably received within the mating slots of the corresponding tracks. Cross-slide 340 may be moved in and out, i.e., in a radial direction with respect to continuous circulation sub 34, by a linear actuator 346. Linear actuator 346 is operatively coupled between cross-slide 340 and base 120. Linear actuator 346 may be a hydraulic or pneumatic cylinder, although other suitable mechanisms may be used, such as a lead screw or rack and pinion assembly.

Figure 10:
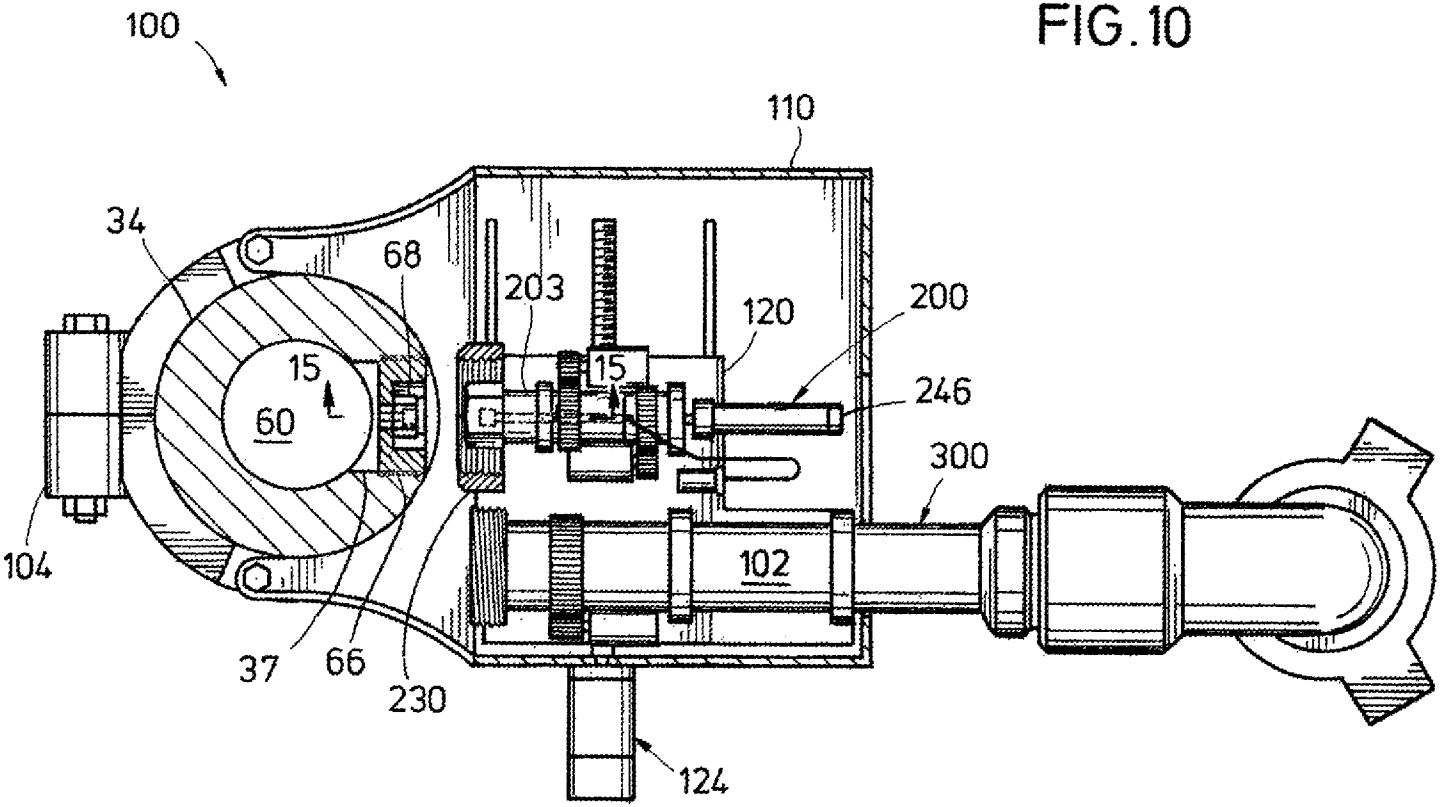
FIG. 10 is a cross-sectional view of the continuous circulation sub connection assembly of FIG. 5, showing the first engagement mechanism transversely aligned for engagement with the side port of the continuous circulation sub.

FIGS. 10-14 are plan views of continuous circulation sub connection assembly 100 according to one or more embodiments, which illustrate a sequence for automatic or semi-automatic connection to side port 37 of continuous circulation sub 34. Referring to FIG. 10, continuous circulation sub connection assembly 100 is first clamped about continuous circulation sub 34 by clamping assembly 104 at an elevation of side port 37. Base 120 is positioned by base actuator assembly 124 so that first engagement mechanism 200 is radially aligned with side port 37. First engagement mechanism 200 is in a retracted state, with coaxial tool assembly 203 disengaged from safety plug 66 and pressure tap 68 by linear actuator to 46.

Figure 15:
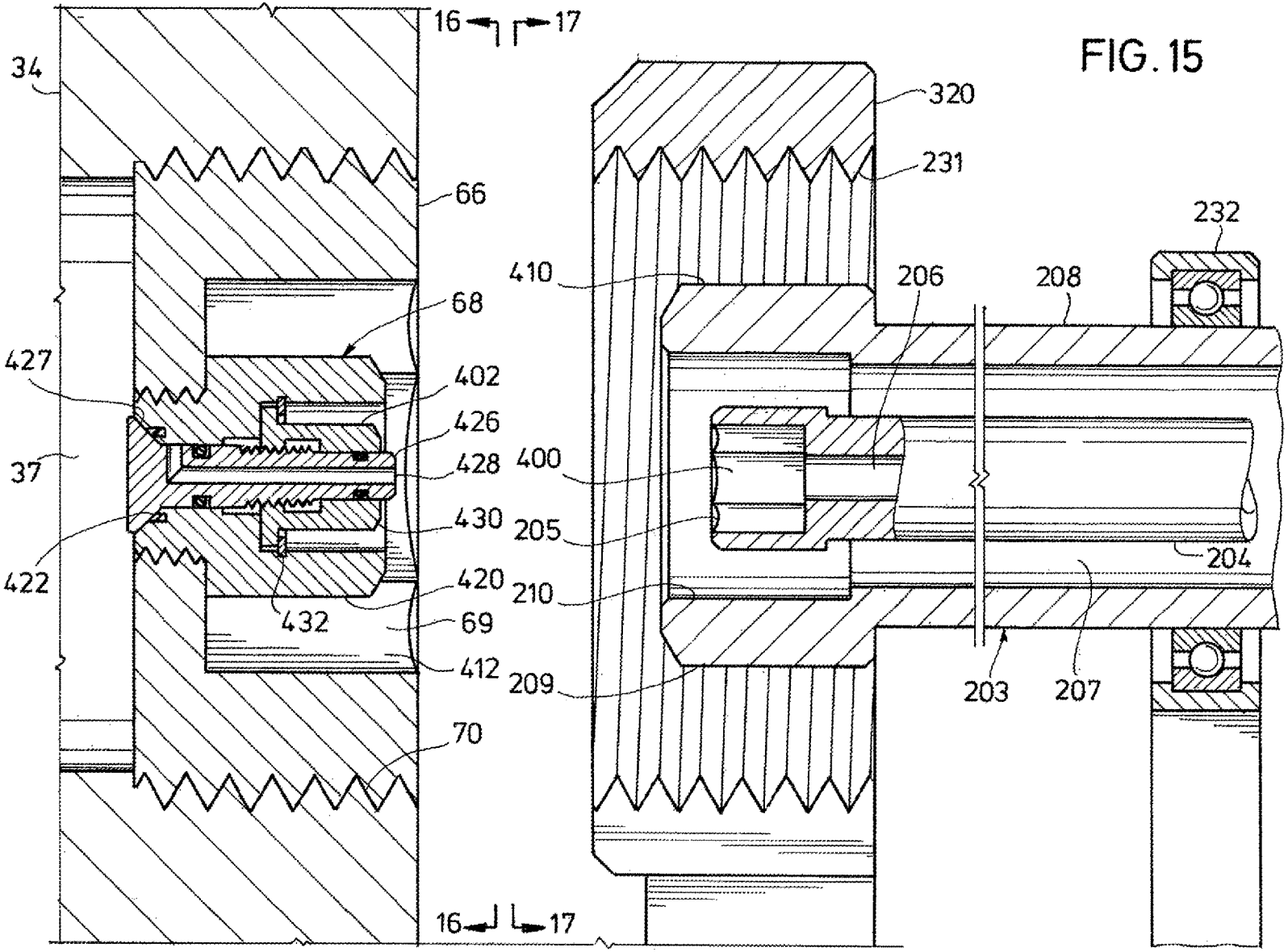
FIG. 15 is a partial cross-section taken along lines 15-15 of FIG. 10, showing detail of the first engagement mechanism and the safety plug.
Figure 16:
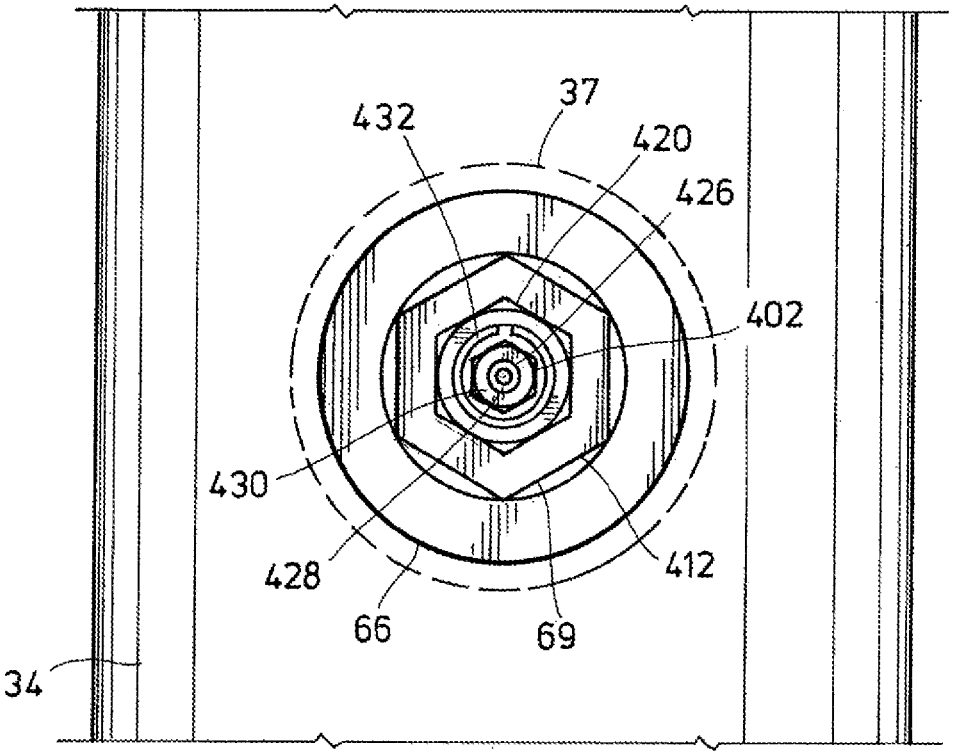
FIG. 16 is an elevation view taken along lines 16-16 of FIG. 15 of the side port of the continuous circulation sub, showing details of the safety plug.
Figure 17:
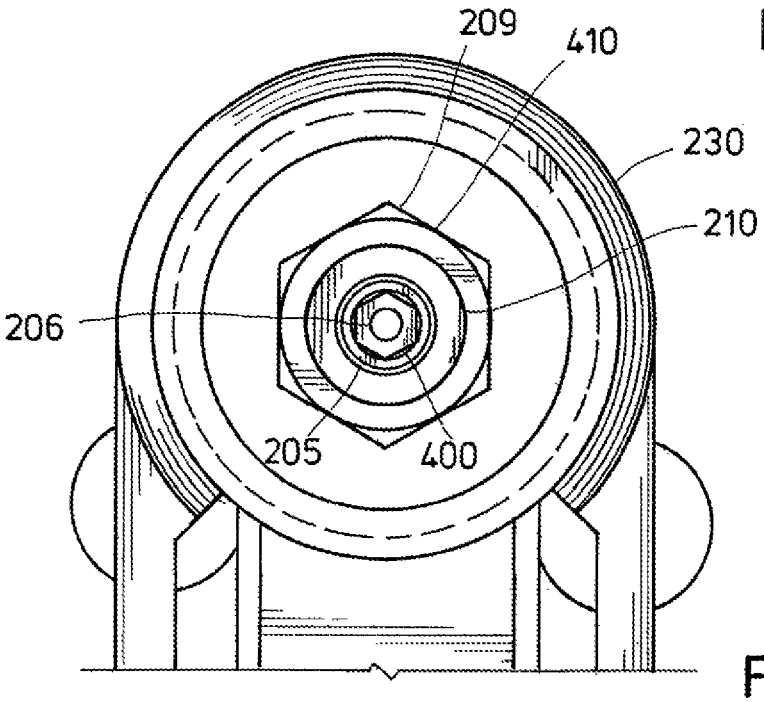
FIG. 17 is an elevation view taken along lines 17-17 of FIG. 15, showing details of the first engagement mechanism.

FIG. 15 is a cross-section taken along lines 15-15 of FIG. 10. FIGS. 16 and 17 are cross-sections taken along lines 16-16 and 17-17 of FIG. 15. FIGS. 15-17 illustrate detail of the connection end of coaxial tool assembly 203, safety cuff 230, safety plug 66, and pressure tap 68 according to one or more embodiments. Referring to FIGS. 15-17, inner wrench 204 has a hollow interior 206. Head 205 has a torque-transmitting profile 400, which may be located within an enlarged bore 210 formed within head 209 of outer wrench 208. Torque-transmitting profile 400 is dimensioned to engage a torque-transmitting profile 402 of pressure tap 68. Torque-transmitting profile 400 is illustrated as having an internal hexagonal shape, and torque-transmitting profile 402 is illustrated as having a complementary external hexagon shape. However, torque-transmitting profile 400 may have an external shape, and torque-transmitting profile 402 may have an internal shape, such as described below with respect to FIG. 19. Moreover, torque-transmitting profiles 400, 402 other than hexagonal may be used and are considered within the scope of the present disclosure.

Similarly, head 209 of outer wrench 208 has a torque-transmitting profile 410, which is dimensioned to engage a torque-transmitting profile 412 of safety plug 66. Torque-transmitting profile 410 is illustrated as having an external hexagonal shape, and torque-transmitting profile 412 is illustrated as having a complementary internal hexagonal shape. However, torque-transmitting profile 410 may have an internal shape, and torque-transmitting profile 412 may have an external shape. Moreover, torque-transmitting profiles 410, 412 other than hexagonal may be used in are considered within the scope of the present disclosure. Enlarged bore 210 may be provided to accommodate pressure tap 68 to be received within head 209, as described hereinafter.

Safety plug 66 may have a tapered thread 70 for producing a fluid tight seal with side port 37 of continuous circulation sub 34. Safety plug 66 is illustrated as having an external thread 70, and side port 37 is illustrated as having a complementary female thread. Safety cuff 230 has partial circular internal surface with internal threads 231 dimensioned to receive safety plug 66. The internal threads 231 of safety cuff 230 may be, but are not necessarily, tapered, as a fluid-tight seal is not required between safety plug 66 and safety cuff 230. Although not illustrated, in one or more embodiments, safety plug 66 may be a cap having a female thread that may be screwed on a recessed threaded nipple within side port 37. In this case, safety cuff 230 may non-threadedly engage an external surface of safety plug 66 for temporarily retaining safety plug 66.

In one or more embodiments, pressure tap 68 is arranged to be stabbed by head 205 of inner wrench 204 and then rotated by inner wrench 204 to open pressure tap 68 and allow fluid communication between the interior of side port 37 and the interior of inner wrench 204. Pressure tap 68 may include a nut 420 having a through-bore that is installed within socket 69 of safety plug 66, with the bore extending into the interior of side port 37. An inner tapered surface 422 of nut 420 defines a valve seat. A bonnet 430, having a partially threaded through-bore, may be rotatively captured within an outer portion of the bore of nut 420 by a C-clip 432 or the like. A partially threaded valve stem 426 may be axially disposed within the bores of nut 420 and bonnet 430, with the threaded portion of valve stem 426 engaging the threaded portion of the bore of bonnet 430. Valve stem 426 has an inner tapered seating surface 427 that complements valve seat 422. Rotation of bonnet 430 by head 205 of inner wrench 204 is operable to cause valve stem 426 to axially move within the bores of nut 420 and bonnet 430. Valve stem 426 may have a conduit 428 formed therein that extends from a side of valve stem 426 at a point outside tapered seating surface 427 to an outer end of valve stem 426. As shown in FIG. 15, valve stem 426 is positioned so that tapered seating surface 427 is in sealing contact with valve seat 422, and conduit 428 is fluidly isolated from the interior of side port 37. Although a particular embodiment for pressure tap 68 is illustrated, other suitable arrangements may be used and are considered to be within the scope of the present disclosure.

Figure 11:
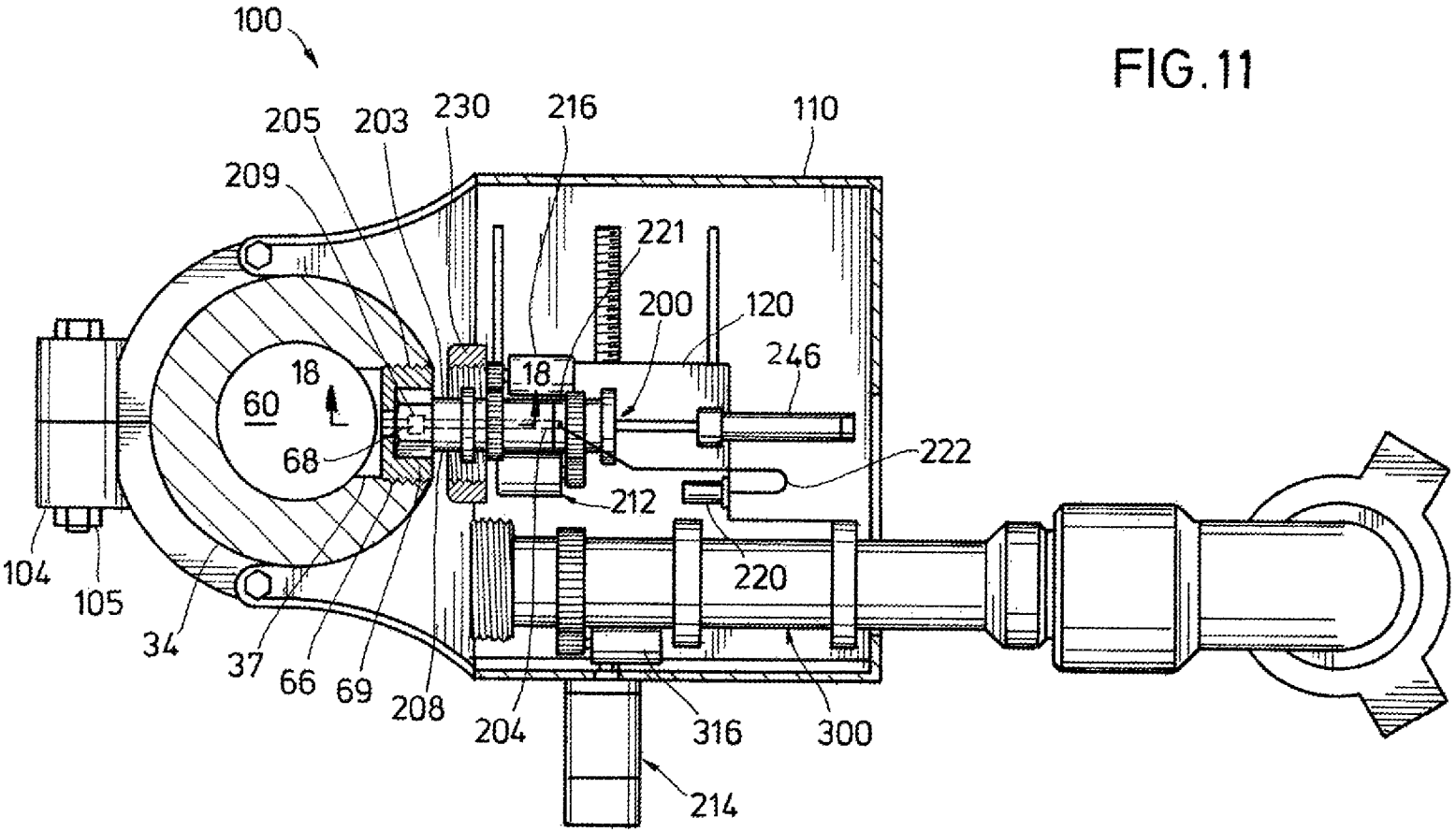
FIG. 11 is a cross-sectional view of the continuous circulation sub connection assembly of FIG. 10, showing the first engagement mechanism engaged with a safety plug threaded within the side port of the continuous circulation sub.
Figure 18:
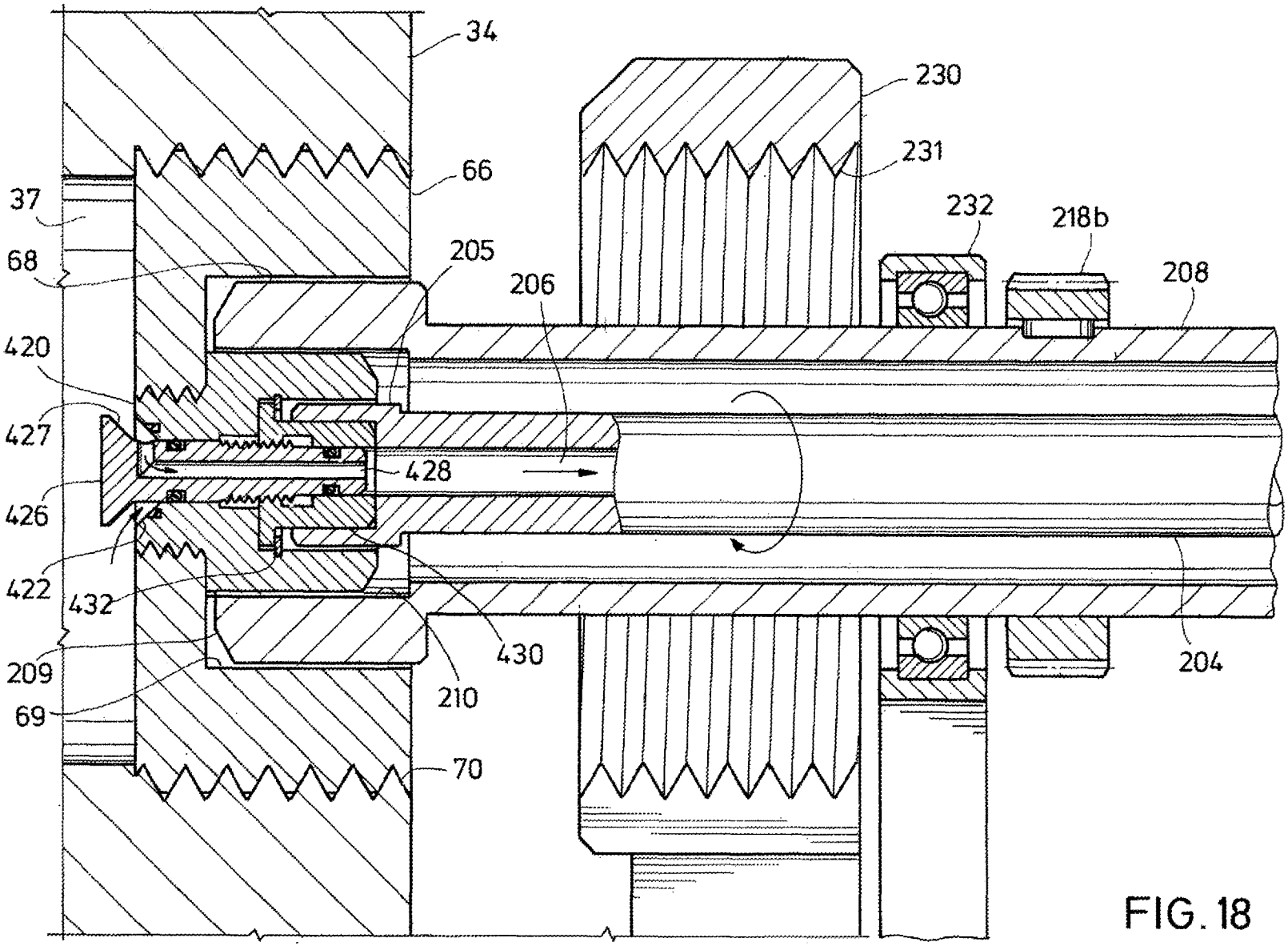
FIG. 18 is a partial cross-section taken along lines 18-18 of FIG. 11, showing the first engagement mechanism engaged with the safety plug of the continuous circulation sub.

FIG. 18 is a partial cross-section taken along lines 18-18 of FIG. 11, showing detail the connection end of coaxial tool assembly 203, safety cuff 230, safety plug 66, and pressure tap 68. Referring now to FIGS. 11 and 18, linear actuator 246 is extended to move cross-slide 240 (FIG. 6), with coaxial tool assembly 203 and actuator assemblies 212, 216, into engagement with continuous circulation sub 34. Head 205 of inner wrench 204 engages pressure tap 68, and head 209 of outer wrench 208 engages socket 69 of safety plug 66. Actuator assemblies 212 and 216 may be slowly rotated if necessary while extending coaxial tool assembly 203 in order to align the torque-transmitting profiles of head 205 with pressure tap 68 and head 209 with socket 69. Alternatively, self-aligning stabable torque-transmitting profiles (not illustrated) may be used to facilitate alignment and engagement of coaxial tool assembly 203 with continuous circulation sub 34.

As described above, pressure tap 68 may be arranged to be operated by inner wrench 204 to open pressure tap 68 and allow fluid communication between the interior of side port 37 and the interior of inner wrench 204. In the embodiment illustrated, pressure tap 68 includes nut 420 having a through-bore. Nut 420 is installed within socket 69 of safety plug 66, with its bore extending to the interior of side port 37. Inner tapered surface 422 of nut 420 defines a valve seat. Bonnet 430, having a partially threaded through-bore, is rotatively captured within an outer portion of the bore of nut 420 by C-clip 432. Partially-threaded valve stem 426 is axially disposed within the bores of nut 420 and bonnet 430, with the threaded portion of valve stem 426 engaging the threaded portion of the bore of bonnet 430. Valve stem 426 has an inner tapered seating surface 427 that complements valve seat 422.

As illustrated in FIGS. 11 and 18, actuator assembly 212 may be automatically or semi-automatically operated to rotate inner wrench 204. Inner wrench 204 in turn rotates bonnet 430 with head 205, causing valve stem 426 to axially move inward and therefore position conduit 428 to be in fluid communication with the interior of side port 37. The pressure from the interior of side port 37 is then communicated via conduit 428, interior 206 of inner wrench 204, sealing fluid swivel assembly 221 (best seen in FIG. 6), and tube 222 to pressure sensing device 220. Pressure sensing and/or bleeding device 220 measures the pressure within the interior of side port 37 downstream of radial valve 64 (FIG. 4). If the pressure is at an acceptable level, indicating no leakage past radial valve 64, any residual pressure within inner wrench 204 may be automatically or semi-automatically bled by pressure sensing device 220. Actuator assembly 212 may then be operated in a reverse direction to reseat valve stem 426 thereby shutting pressure tap 68.

Figure 12:
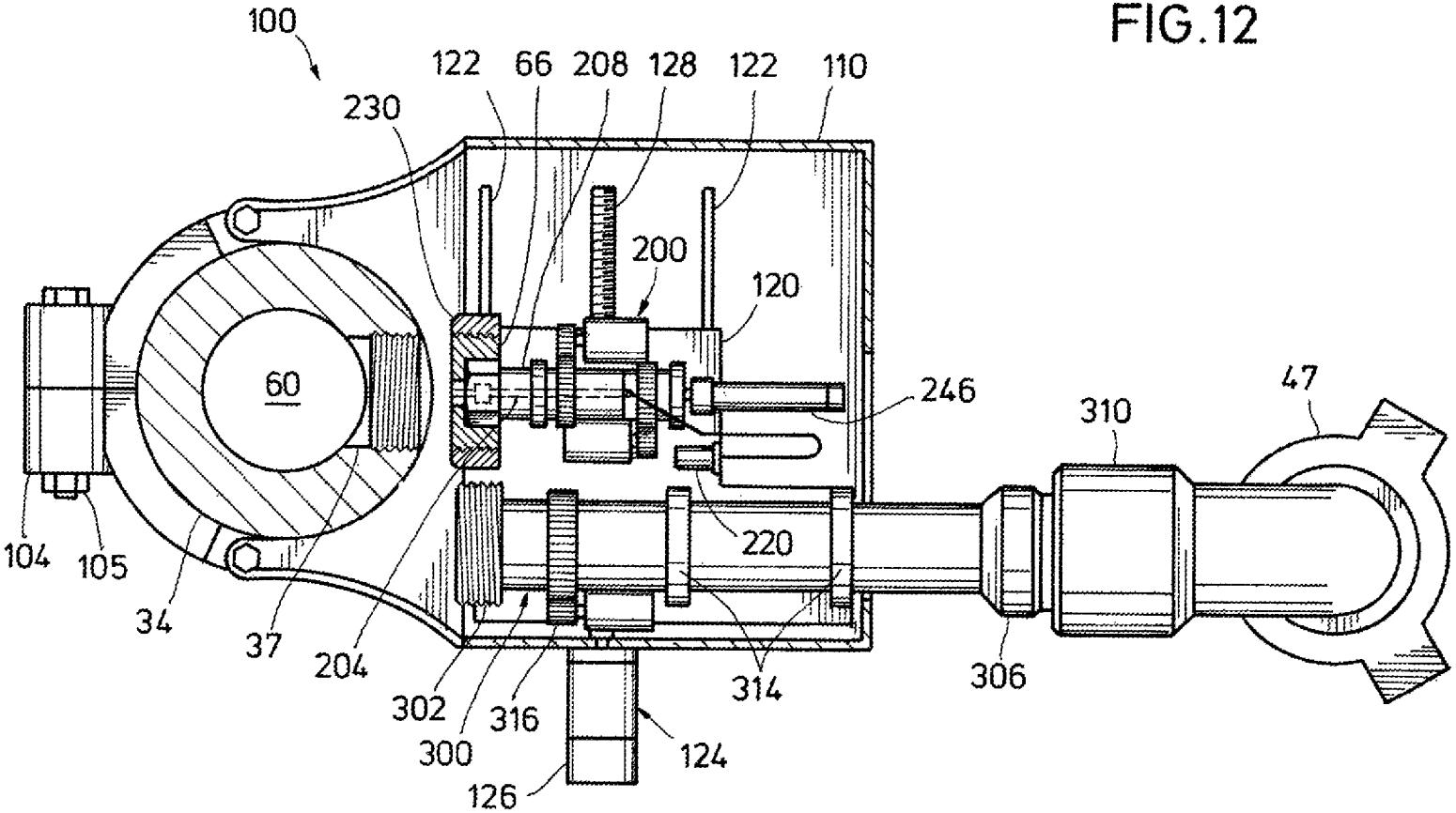
FIG. 12 is a cross-sectional view of the continuous circulation sub connection assembly of FIG. 11, showing the safety plug removed from the side port of the continuous circulation sub and retained within a safety cuff of the first engagement mechanism.

Thereafter, actuator assembly 216 may be automatically or semi-automatically operated to rotate outer wrench 208. Head 209, engaged within socket 69 of safety plug 66, unscrews safety plug 66 from the threaded side port 37. Actuator assembly 216 is suitably powerful to provide the required torque to unscrew safety plug 66 from side port 37. As actuator assembly 216 is rotated, linear actuator 246 may be slowly retracted thereby allowing removal of safety plug 66 from side port 37. As safety plug 66 is unscrewed, it engages and is threadedly received within safety cuff 230. Safety cuff 230 may be radially positioned with respect to continuous circulation sub 34 so that at no time is safety plug 66 at risk from being dislodged from head 209. A limited amount of radial play (with respect to continuous circulation sub 34) may be provided for safety cuff 230 with respect to base 120 to accommodate for any misalignment of threads 231 of safety cuff 230 and threads 70 of side port 37, thereby minimizing the tendency for safety plug 66 to become jammed during extraction. FIG. 12 illustrates continuous circulation sub connection assembly 100 with first engagement mechanism 200 in a retracted state after extraction of safety plug 66 from side port 37. Safety plug 66 is securely held within safety cuff 230.

Figure 19:
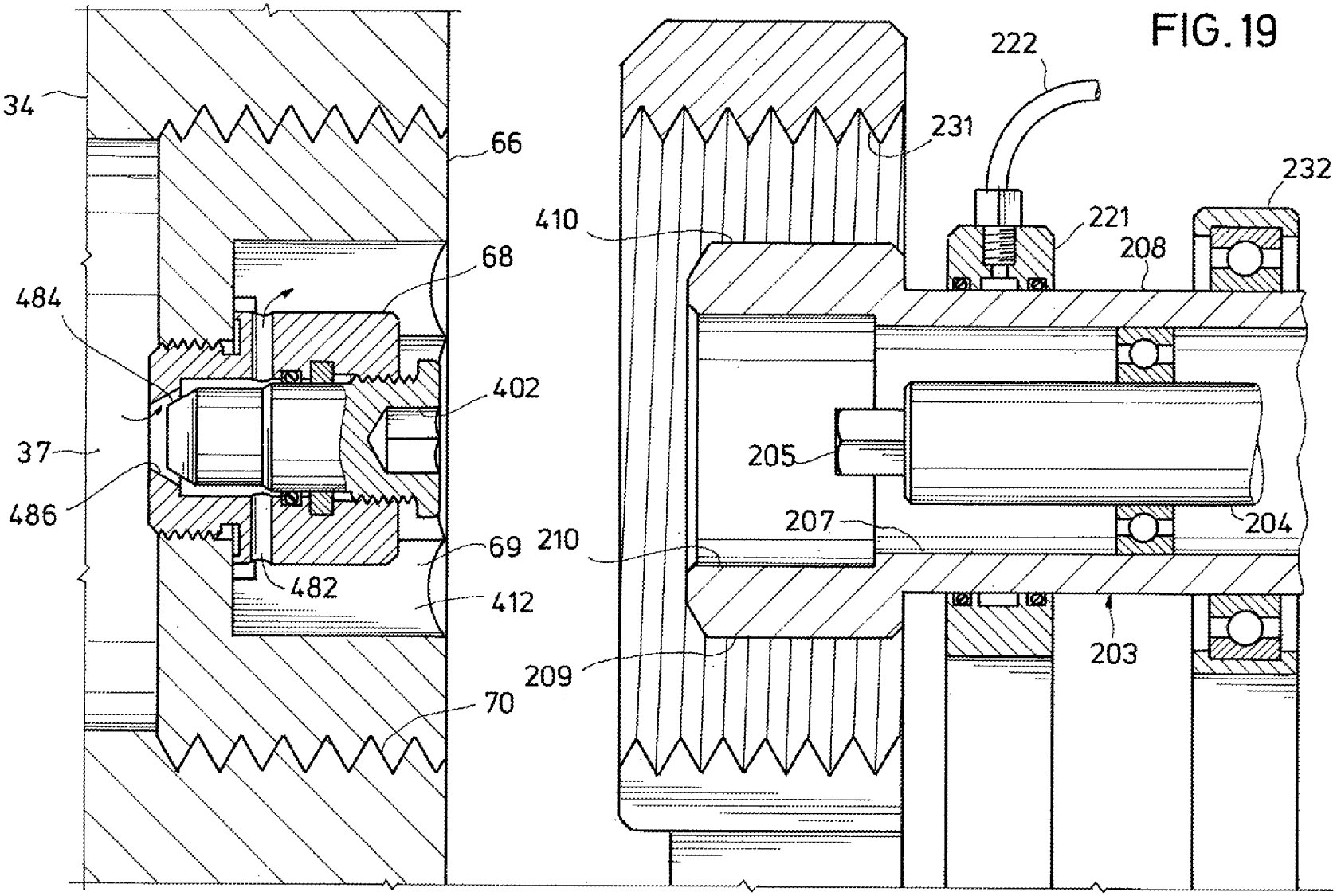
FIG. 19 is a cross-section of a safety plug and pressure tap of a continuous circulation sub according to an embodiment, arranged for fluid communication via an annular region formed between an inner and outer wrench.

FIG. 19 is a cross-section of safety plug 66 and coaxial tool assembly 203 according to one or more embodiments. Inner wrench 204 may a solid interior. Head 205, which may be located within an enlarged bore 210 formed within head 209 of outer wrench 208 has an external torque-transmitting profile 400 dimensioned to be received within and engage a torque-transmitting profile 402 of pressure tap 68. Similarly, head 209 of outer wrench 208 has a torque-transmitting profile 410, which is dimensioned to engage a torque-transmitting profile 412 of safety plug 66. Enlarged bore 210 may be provided to accommodate pressure tap 68 to be received within head 209.

Pressure tap 68 is arranged to be stabbed by head 205 of inner wrench 204 and then rotated by inner wrench 204 to open pressure tap 68 and allow fluid communication between the interior of side port 37 and an annular region of interior 207 of outer wrench 208. Pressure tap 68 may include a valve stem 480 threaded within a through-bore of pressure tap 68 to allow selectively isolable fluid communication between the interior of side port 37 and an exterior opening 482 of pressure tap 68. A tapered surface 484 of valve stem 480 defines a sealing surface with a tapered valve seat 486 of pressure tap 68. When coaxial tool assembly 203 is engaged with safety plug 66, the distal end surface of head 209 may form a seal with the bottom of socket 69, and exterior opening 482 is in fluid communication with interior 207 of outer wrench 208. A fluid seal 221 may communicate pressure from interior 207 to pressure sensing device 220 (e.g., FIG. 5) via tubing 222.

Although pressure tap 68 has been scribed herein as a threaded component that may be opened and shut by rotation, in one or more embodiments, pressure tap may be engaged and operated by other arrangements. For example, pressure tap 68 may include a biased push-style valve (not illustrated) that is opened by axial translation of a poppet, a Zirk-type fitting, pop-off assembly, or the like. In such a case first engagement assembly 200 may be modified from that described herein to suitably engage and operate pressure tap 68.

Figure 13:
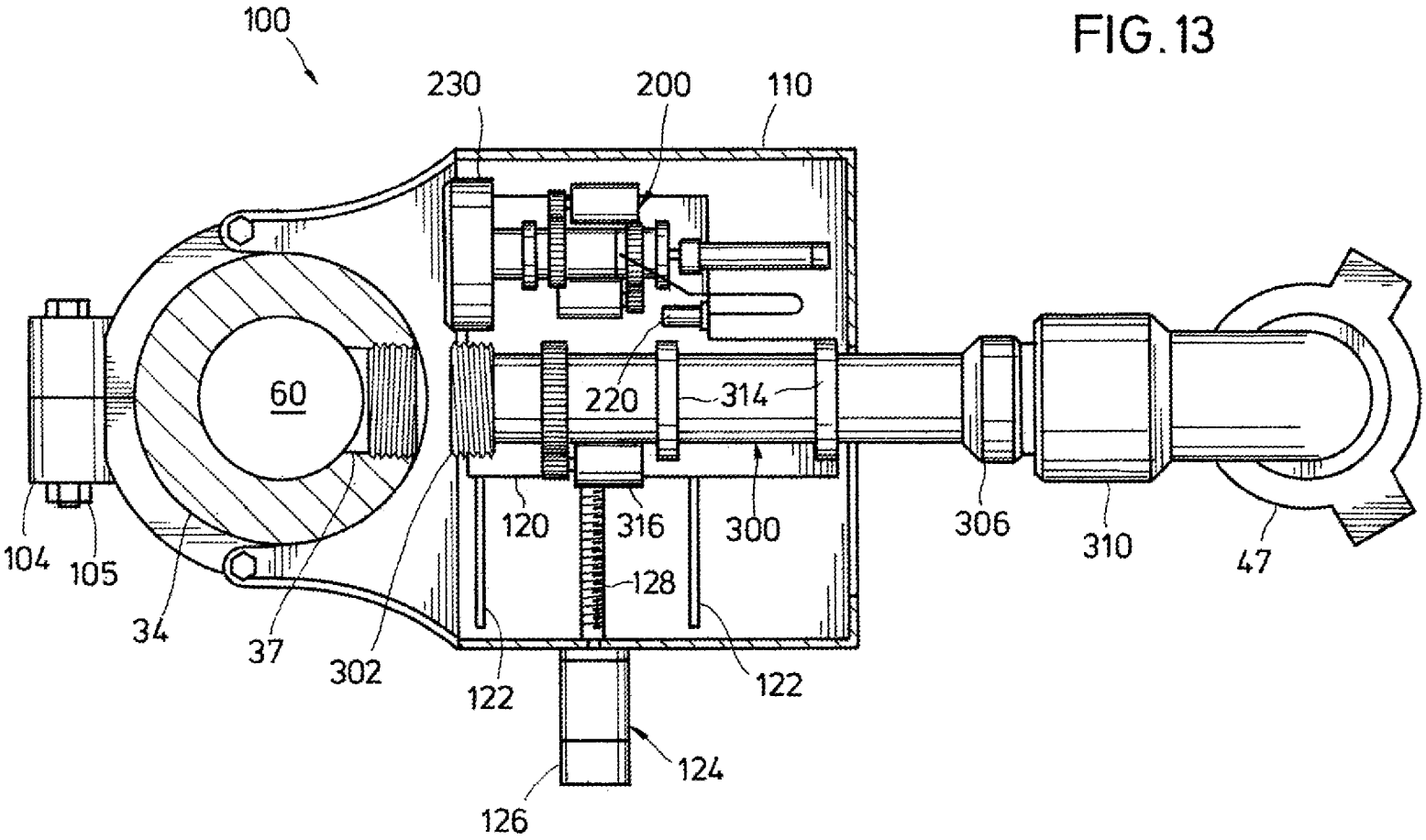
FIG. 13 is a cross-sectional view of the continuous circulation sub connection assembly of FIG. 12, showing the second engagement mechanism transversely aligned for engagement with the side port of the continuous circulation sub.

Referring now to FIG. 13, continuous circulation sub connection assembly 100 is illustrated during the next stage of operation. After extraction of safety plug 66 from side port 37, base actuator assembly 124 may be automatically or semi-automatically operated to transversely move base 120 so as to radially align second engagement mechanism 300 with side port 37. Adapter pipe 102 is positioned for being threaded lay engaged into side port 37.

Figure 14:
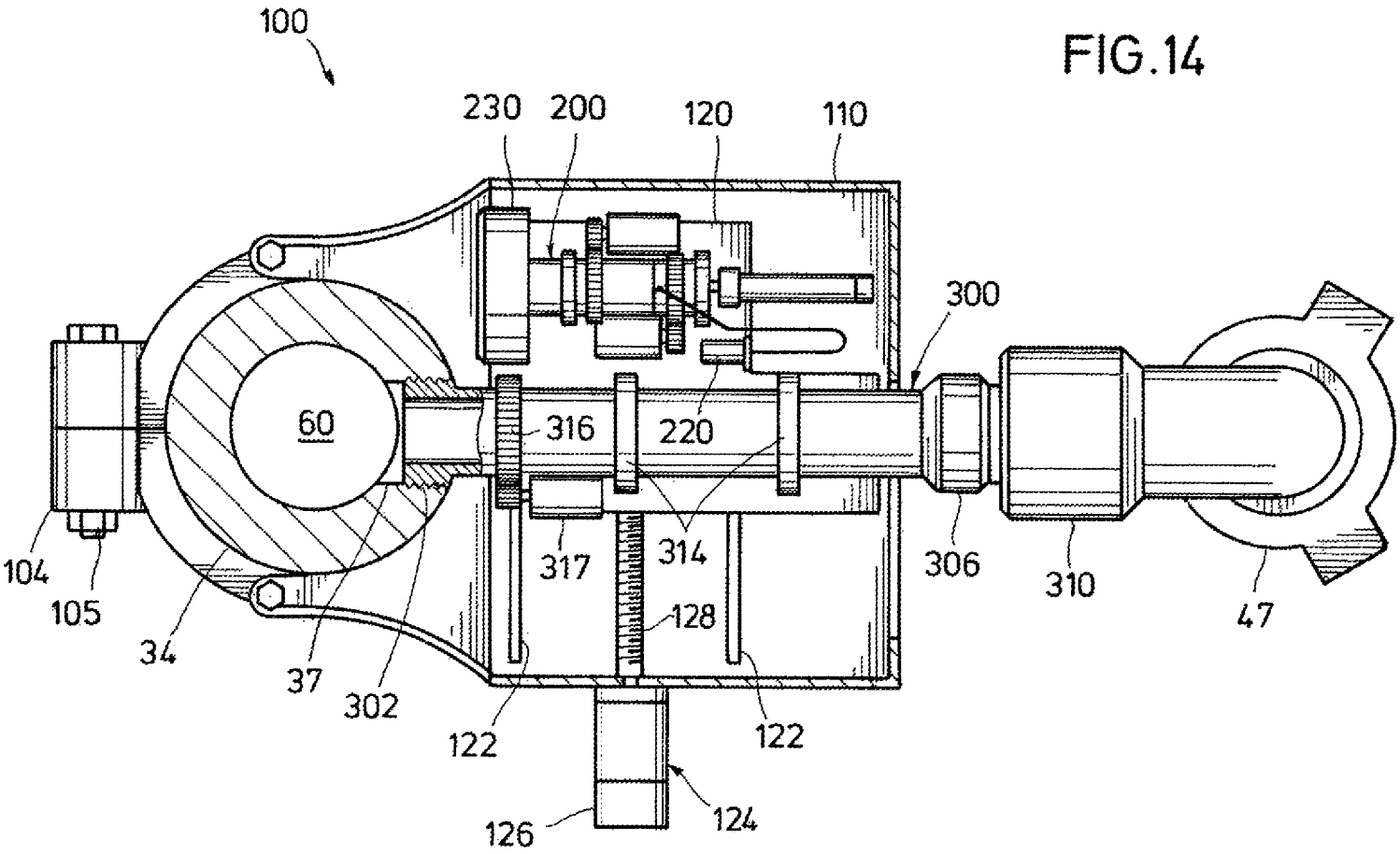
FIG. 14 is a cross-sectional view of the continuous circulation sub connection assembly of FIG. 13, showing the adapter pipe of the second engagement mechanism threaded within the side port of the continuous circulation sub.

Turning now to FIG. 14, linear actuator 316 (FIG. 7) is automatically or semi-automatically operated to extend adapter pipe 102 toward continuous circulation sub 34. Simultaneously, actuator assembly 316 is automatically or semi-automatically operated to rotate adapter pipe 102 so as to screw connection end 302 of adapter pipe 102 into threaded side port 37. Actuator assembly 316 is suitably powerful to apply a required torque to adapter pipe 102 to provide a high-pressure fluid-tight threaded seal between adapter pipe 102 and continuous circulation sub 34.

When circulation via side port 37 of continuous circulation sub 34 is no longer required, the above-described sequence of operations may be automatically or semi-automatically reversed to unscrew and remove adapter pipe 102 from side port 37 and reinsert and torque safety plug 66 within side port 37 to provide a high-pressure fluid-tight threaded seal.

Figure 20:
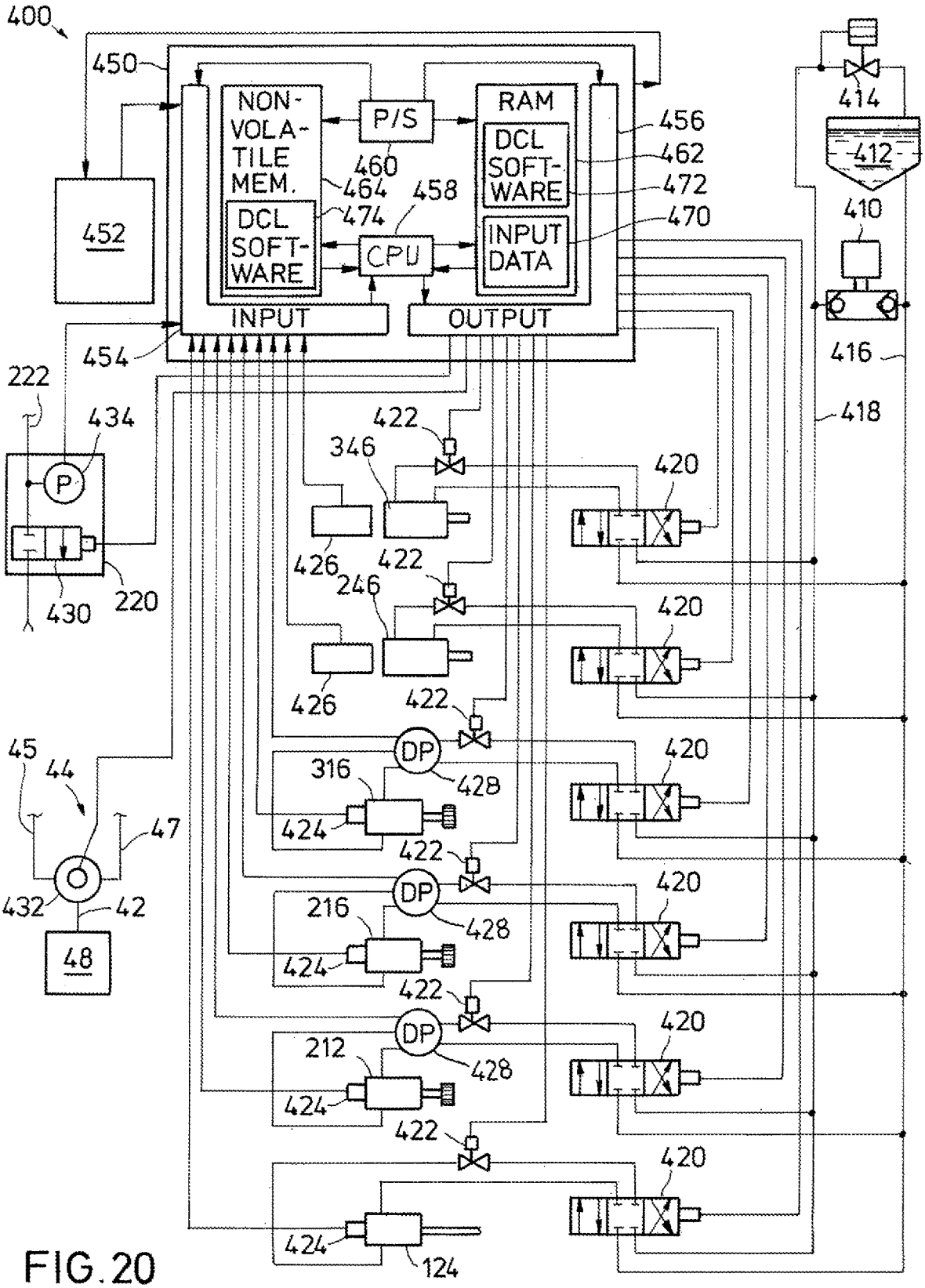
FIG. 20 is a schematic diagram of a control system for the continuous circulation sub connection assembly of FIG. 1, according to an embodiment.

FIG. 20 is a schematic diagram of a control system 400 for continuous circulation sub connection assembly 100 according to one or more embodiments using hydraulic components. Referring now to FIG. 20, actuator assemblies 212, 216, 316, linear actuators 246, 346, pressure sensing device 220, and flow manifold 44 may be controlled by a control system 400. Control system 400 may be operable to automatically or semi-automatically coordinate operation of these various devices to effect the process described above.

Control system 400 may be computer controlled and arranged to operate all actuators, motors, valves, etc. of continuous circulation sub connection assembly 100. Control system 400 allows tasks requiring precise motion control of complex combinations of multi-axis movements to be repetitively performed, thereby allowing complete automation. However, control system 400 may also provide a manual override capability as well.

Control system 400 may include a programmable logic controller or other controller 450, operator controls 452, various solenoid-operated hydraulic valves 420, 422 and other appropriate electromechanical position, speed, acceleration, pressure, torque, strain sensors, etc., for feedback. Operator controls 452 may be located remotely from the rig floor. Control system 400 may automatically or semi-automatically control base actuator assembly 124, actuator assemblies 212, 216, 316, and linear actuators 246, 346 to provide precise positioning, coordinating, torqueing, and supervising. Control system 400 may also control pressure sensing device 220 for bleeding pressure from tube 222. In one or more embodiments, control system 400 may also control the operation of flow manifold 44.

In one or more embodiments, controller 450 may include input handling circuitry 454, output handling circuitry 456, a central processing unit 458, a power supply 460, volatile memory 462, and non-volatile memory 464. Central processing unit 458 scans the status of the input devices continuously via the input circuitry 454, correlates the received input with the control logic in memory 462, 464, and produces the appropriate output responses needed to control continuous circulation sub connection assembly 100 via output circuitry 456. Power supply 460 contains power conditioning circuitry that receives mains power and supplies regulated power to the input and output circuitry 454, 456, central processing unit 458, and memory 462, 464. The controller 450 has adequate memory capacity and functional capabilities to also handle required mathematical calculations and maintain high-level communications in real time.

Input to controller 450 may be in either discrete or continuous form, or a combination of both. Discrete inputs may come from push buttons, micro switches, limit switches, photocells, proximity switches, shaft encoders, optical scales, or pressure switches, for instance. Continuous inputs may come from sources such as strain gauges, resolvers, thermocouples, transducers, resistance bridges, potentiometers, or voltmeters. Outputs from controller 450, which may be analog and/or digital, are generally directed to actuating hardware such as solenoids, solenoid valves, motor starters, and servo or stepping motor drive circuitry. Controller 450 examines the status of a set of inputs and, based on this status and instructions coded in digital control logic software, actuates or regulates a set of outputs. Controller 450 is designed to have a sufficient number of input and output channels in circuitry 454, 456 to control all devices of continuous circulation sub connection assembly 100.

Central processing unit 458 is preferably a microprocessor or microcontroller, although discrete special-purpose electronic logic circuits may be used. Controller 450 word size may range from 8 to 64 bits, depending on design requirements, but the central processing unit 458 and memory 454, 456 are selected to be capable of processing words of sufficient size at a sufficient speed so as to accurately and simultaneously control all devices of continuous circulation sub connection assembly 100 in real time as required.

Controller 450 may include both random access memory 462, which due to its relative ease of programming and editing, is primarily used to store input data 470 and frequently changing digital control logic software 472, and non-volatile memory 464, such as electronically erasable programmable read-only memory, which retains its logic without power. Non-volatile memory is preferable to store digital control logic software 474 that is expected to be infrequently changed. Non-volatile memory 464 may include read-only memory. Read-only memory, which cannot be reprogrammed, is preferred to store low level interface software programs, often referred to as firmware, that contain specific instructions to allow the higher level digital control logic software to access and control a specific piece of equipment, e.g., sophisticated motor drives 280. Because such low-level hardware-dependent software may be intimately tied to the device it controls, read-only memory may be collocated with its associated device.

Instructions that are input to controller 450, referred to as digital control logic (DCL) software programs 472, 474 may be provided as a sequence of commands that completely describes every operation to be carried out by continuous circulation sub connection assembly 100. When DCL software program 272, 274 is executed, each instruction is interpreted by central processing unit 458, which causes an action such as starting or stopping of an actuator, changing drive motor speed or rotation, or moving a cross-slide in a specified direction, distance, and speed. In one or more embodiments, control system 400 may accept programming instructions by manual data input or computer assisted input. Manual data input permits the operator to insert machining instructions directly into controller 450 via greater controls 452, which may include push buttons, pressure pads, knobs, or other arrangements.

Control system 400 may be capable of adaptive control, i.e., measuring performance of a process and then adjusting the numeric control parameters to obtain optimum performance. In other words, adaptive control is a process of adjusting the speed or position of a motor or actuator based on sensor feedback information directly representative of the quality of the process to maintain optimum conditions.

Control system 400 may include open-loop control, closed-loop control, or a combination of both. In open-loop control, control system 400 issues commands to the drive motors or actuators, but control system 400 has no means of assessing the results of these commands; no provision is made for feedback of information concerning movement of a slide or rotation of a lead screw, for example.

FIG. 20 illustrates an open-loop control arrangement according to one or more embodiments using hydraulic devices. Pressure sensing and/or bleeding device 220 may include a bleed valve 430, which may be actuated by controller 450 via a channel of output circuitry 456. No feedback is provided. Similarly, flow manifold 44 may include a continuously variable three-way valve 432 that allows fluid flow from mud pump 48 to be selectively divided between flow lines 45 and 47 for transitioning drilling fluid flow to continuous circulation sub 34 (FIGS. 2, 4) from axial entry to side port entry. Three-way valve 432 is actuated by controller 450 via a channel of output circuitry 456 with no position feedback.

In closed-loop control, also referred to as feedback control, control system 400 issues commands to the motors and actuators and then compares the results of these commands to the measured movement or location of the driven component. Feedback devices for measuring movement or location may include resolvers, encoders, transducers, optical scales, and other suitable devices. A resolver is a rotary analog mechanism commonly connected to lead screws actuators. Accurate linear measurement may be derived from monitoring the angle of rotation of the lead screw. An encoder is also frequently connected to a lead screw of an actuator, but measurements are in digital form. Digital pulses in binary code form are generated by rotation of the encoder and represent angular displacement of the lead screw. A transducer may produce an analog signal and may be attached to ways 122, 242, 342 (FIG. 9) to measure the position of base 120 and cross-slides 240, 340, respectively. An optical scale functions similarly to a transducer but produces information in digital form. Additionally, other feedback sensors, such as strain gauges, pressure sensors, etc. may be used.

FIG. 20 also illustrates a closed-loop control arrangement according to one or more embodiments using hydraulic devices. A recirculating source of pressurized hydraulic fluid may be provided by a hydraulic pump 410, reservoir 412, and recirculation valve 414. A supply header 416 and a return header 418 are fluidly coupled to hydraulic pump 410.

Base actuator assembly 124 may be fluidly connected to hydraulic headers 416, 418 via a selector valve 420 and a throttle valve 422. Valve 420 may be automatically or semi-automatically controlled by controller 450 via a channel of output circuitry 456 to isolate hydraulic flow to base actuator assembly 124, to drive base actuator assembly 124 in a forward direction, or to drive base actuator assembly 124 in a reverse direction. Throttle valve 422 may be automatically or semi-automatically controlled via a channel of output circuitry 456 to regulate flow to, and thereby the speed of, base actuator assembly 124. Similarly, actuator assemblies 212, 216, 316 may be fluidly connected to hydraulic headers 416, 418 via independent selector valves 420 and throttle valves 422, which may be automatically and independently controlled by controller 450. Base actuator assembly 124 and actuator assemblies 212, 216, 316 may each include a resolver or encoder 424, the feedback signals of which are received at input circuitry 454 and processed by controller 450 for accurately controlling and coordinating these devices.

To ensure proper torque is applied for effecting high-pressure threaded seals with side port 37 of continuous circulation sub 34 when connecting adapter pipe 102 or reinstalling safety plug 66 (FIGS. 3 and 4), pressure sensors 428 may be provided in association with actuator assemblies 216, 316. Similarly, a pressure sensor 428 may be provided in association with actuator assembly 212 to ensure proper torque is applied to pressure tap 68 (FIG. 3). Pressure sensors 428 may provide information relating to the differential pressure operating across to controller 450 via input circuitry 454. Based on the differential pressure applied across actuator assemblies 212, 216, 316, controller 450 may calculate the applied torque.

Figure 7:
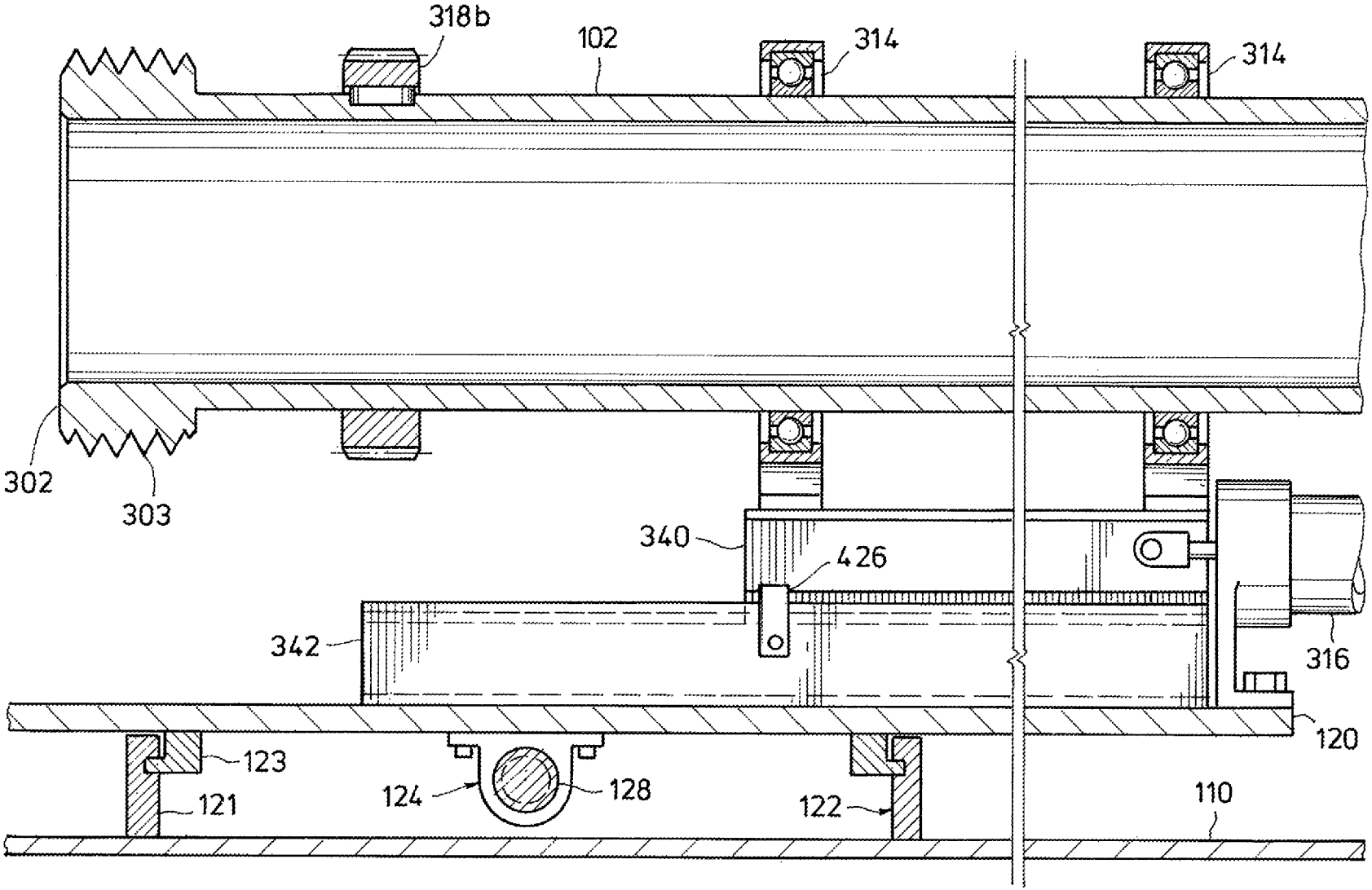
FIG. 7 is a partial cross-section taken along lines 7-7 of FIG. 5, showing details of the second engagement mechanism, including the adapter pipe of FIG. 4.
Figure 8:
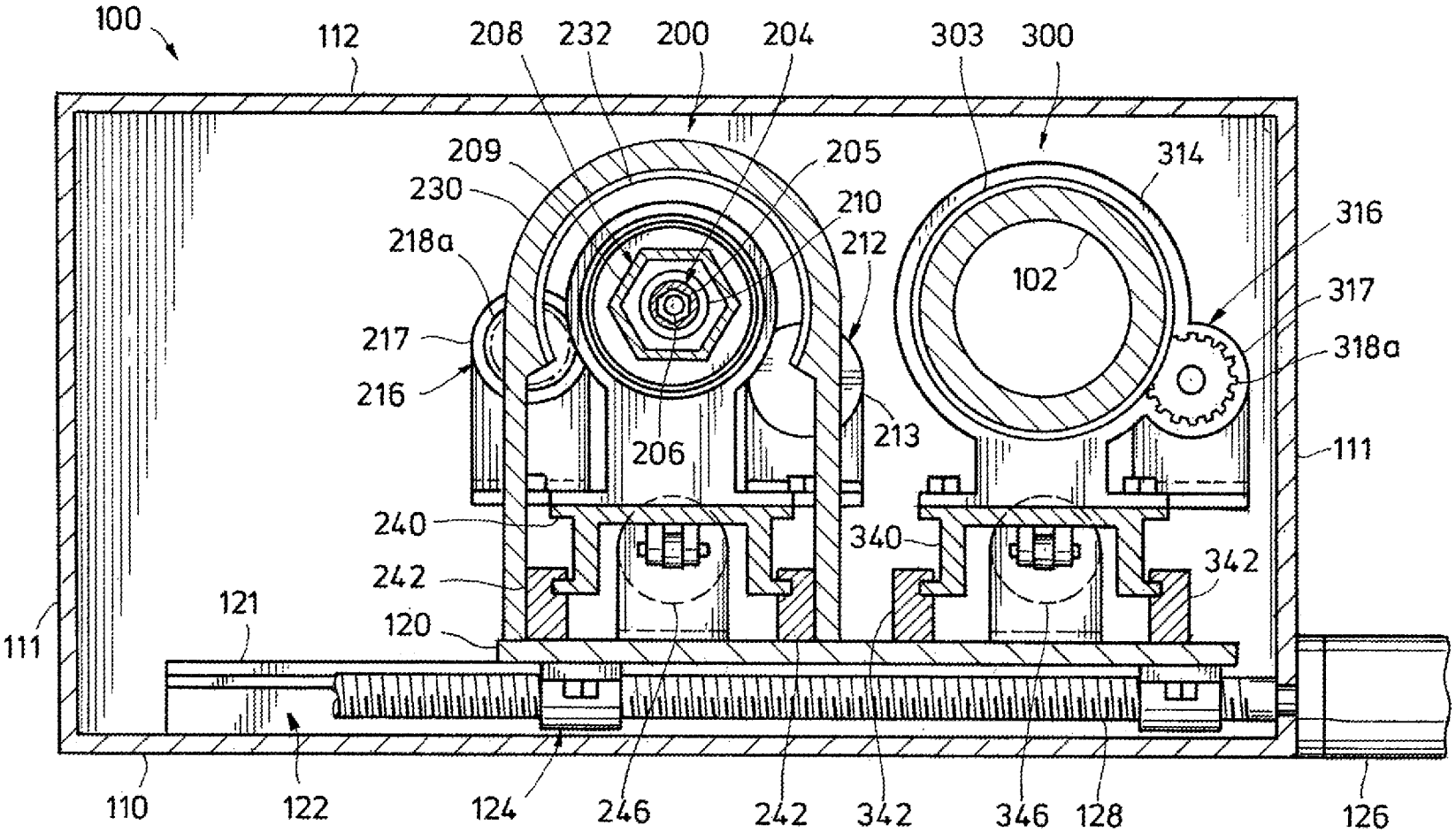
FIG. 8 is a transverse cross-section taken along lines 8-8 of FIG. 5, showing details of the first and second engagement mechanisms.
Figure 9:
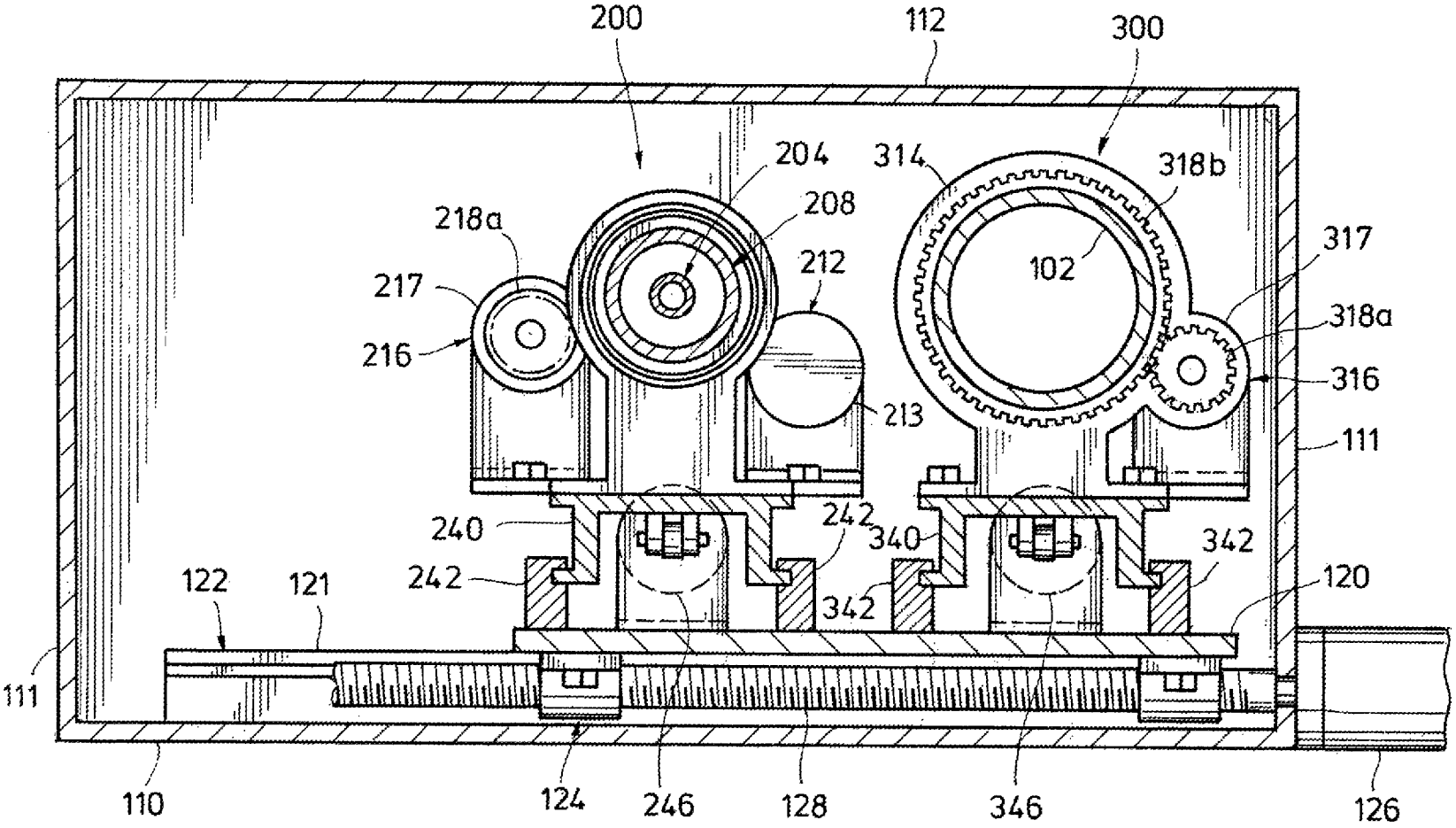
FIG. 9 is a transverse cross-section taken along lines 9-9 of FIG. 5, showing details of the first and second engagement mechanisms.

In a like manner, linear actuators 246, 346 may be fluidly connected to hydraulic headers 416, 418 via independent selector valves 420 and throttle valves 422, which may be automatically and independently controlled by controller 450. Position sensors 426 may be provided to measure the location of associated cross-slides 240, 340 (FIGS. 6 and 7). Position sensors 426 may be transducers, optical scales, limit switches, proximity sensors, or the like. Position sensors 426 provide feedback signals to controller 450 via input circuitry 454.

Controller 450 may also receive the pressure signal input from a pressure sensor 434 of pressure sensing device 220, thereby allowing determination of the pressure within the region between radial valve 64 and safety plug 66 via pressure tap 68, inner wrench 204, seal assembly 221, and tubing 222 (FIGS. 2 and 6) prior to removal of safety plug 66 from side port 37, as described above.

Although FIG. 20 illustrates a particular embodiment using electromechanical valves, such as solenoid-operated valves 420, 422, 430, for actuating hydraulic components, in one or more embodiments, pneumatically-operated hydraulic valves may also be used. In this case, controller 450 may be operable to control pneumatic circuitry, which in turn operates hydraulic valves. In one or more embodiments, controller 450 may control stepper motors, servo motors, etc. in lieu of hydraulic or pneumatic actuator assemblies via electronic driver circuitry.

Moreover, according to the present disclosure, control system 400 need not include software-based logic elements. Any arrangement that allow autonomous operation of continuous circulation sub connection assembly 100 may be used as appropriate. For example, hydraulic, pneumatic, electric, and/or electronic circuits, components and logic elements, including, directional and flow control valves, regulators, switches, relays, moving-core transformers, and the like may be arranged to provide the required logic and control for automation.

Figure 21:
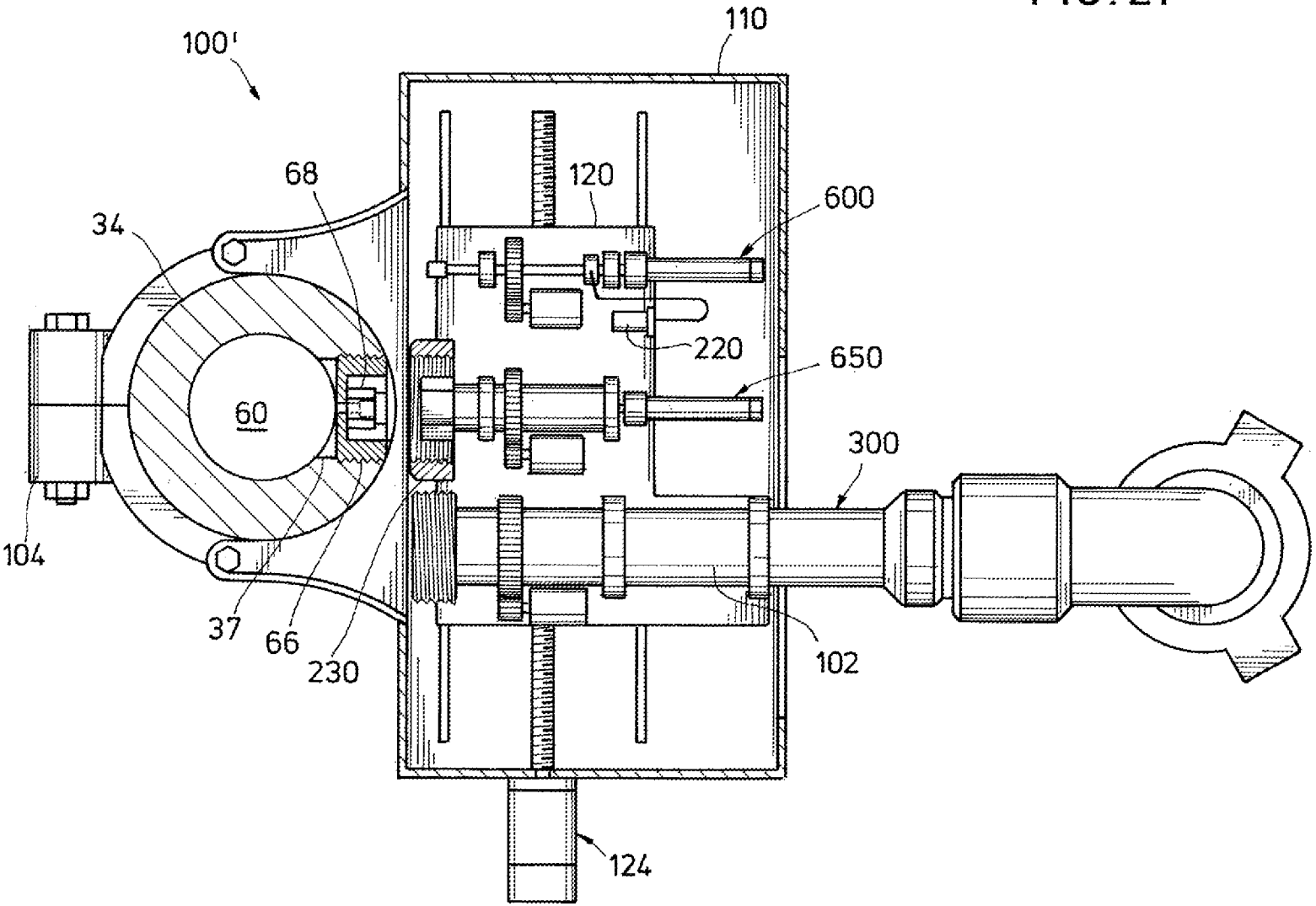
FIG. 21 is a cross-section of a continuous circulation sub connection assembly according to an embodiment, showing first and second wrench assemblies and an adapter pipe.

FIG. 21 is a plan view in partial cross-section of continuous circulation sub connection assembly 100' according to one or more embodiments. Continuous circulation sub connection assembly 100' operates in substantially the same manner as continuous circulation sub connection assembly 100 of FIGS. 5-20 described above, except that coaxial tool assembly 203 of first engagement mechanism 200 is replaced by a first wrench assembly 600 arranged to engage and operate pressure port 68 for checking pressure and a second wrench assembly 650 arranged to extract, hold, and reinsert safety plug 66. Each wrench 600, 650 may be independently rotated and translated toward and away from continuous circulation sub 34.

Although continuous circulation sub connection assembly 100, 100' has been described herein as having engagement mechanisms that are independently translatable in a y direction, i.e., toward and away from continuous circulation sub 34, and side to side and in an x direction via base 120, in one or more embodiments, one or more engagement mechanisms may be independently translatable in both x and y directions. Additionally or alternatively, one or more engagement mechanisms may be translatable in elevation, i.e., a z direction. Moreover, within the scope of the disclosure, the engagement mechanisms are not limited to linear motion. One or more engagement mechanisms, for example, a revolver or turret, may be moved along an arcuate path.

Once clamped onto or otherwise located proximal to a continuous circulation sub, the continuous circulation sub connection assembly described herein may automatically or semi-automatically perform all the steps required to maintain uninterrupted drilling fluid flow via the side port while making a new drill pipe connection or breaking a connection. These steps may include checking pressure within the sub between the radial valve and safety plug, removing the safety plug, screwing the threaded adapter pipe into the side port, providing a flow path for drilling fluid, disengaging the threaded adapter pipe, replacing the safety plug and returning the continuous circulation sub to its original operational state. Additionally, the continuous circulation connection assembly may use other methods besides checking pressure to determine the presence of fluid between the radial valve and the safety plug, including measurement of fluid flow, fluid level, weight, etc. Accordingly, it will be apparent from the foregoing disclosure that the continuous circulation sub connection assembly may be readily operated on the rig floor, thereby removing the requirement for an operator to manually perform the above steps and minimizing the time that personnel are required to be located near the continuous circulation sub during operations.

The continuous circulation sub connection assembly described herein provides a primary high pressure barrier via a threaded connection during the automated or semi-automated process. Elastomeric seals may be unreliable at high operating pressures. Accordingly the use of a threaded side port connection ensures the integrity of the pressure containment system.

In summary, a connection system for interfacing with a continuous circulating sub, a continuous circulation system for drilling wellbores, and a connection assembly for operating a continuous circulating sub have been described. Embodiments of a connection system for interfacing with a continuous circulating sub may generally have: A movable base; a first engagement mechanism carried on the base and including a coaxial tool assembly having a rotatable inner wrench nested inside a rotatable outer wrench; and a second engagement mechanism mounted on the base and including a rotatable tubular adapter pipe carried on the base. Embodiments of a continuous circulation system for drilling wellbores may generally have: A continuous circulation sub having a threaded side port formed therein and a safety plug threadedly received within the side port; and a continuous circulation sub connection assembly arranged for connection to the continuous circulation sub, the connection assembly including a base, a first engagement mechanism movably carried on the base and including a coaxial tool assembly having a rotatable inner wrench nested inside a rotatable outer wrench, a second engagement mechanism movably carried on the base and including a rotatable tubular adapter pipe, a control system operable for selectively and independently controlling translation of the base and the first and second engagement mechanisms and rotation of the inner wrench, the outer wrench, and the adapter pipe. Embodiments of a connection assembly for operating a continuous circulating sub may generally have: A tray; a first engagement mechanism movably carried on the tray and including a selectively rotatable first wrench operable to extract a threaded safety plug from a threaded side port of the continuous circulation sub; and a second engagement mechanism movably carried on the tray and including a rotatable adapter pipe having threads at a connection end thereof, the second engagement mechanism operable to screw the adapter pipe into the threaded side port of the continuous circulation sub to effect a high-pressure threaded seal.

Any of the foregoing embodiments may include any one of the following elements or characteristics, alone or in combination with each other: The first engagement mechanism is carried on the base at a fixed transverse distance from the second engagement mechanism; the first and second engagement mechanisms are independently movable in both transverse and longitudinal directions; the inner wrench, the outer wrench, and the adapter pipe are selectively and independently rotatable in clockwise and counterclockwise directions; the first engagement mechanism further comprises a first actuator assembly coupled to the inner wrench and operable to selectively rotate the inner wrench, and a second actuator assembly coupled to the outer wrench and operable to selectively rotate the outer wrench; the second engagement mechanism further comprises a third actuator assembly coupled to the adapter pipe and operable to selectively rotate the adapter pipe; the connection system further comprises a control system coupled to the first, second, and third actuator assemblies for selectively and independently controlling the first, second, and third actuator assemblies; the base is selectively and independently movable in a transverse direction by a base actuator assembly; the first engagement mechanism further comprises a first cross-slide movably carried upon the base operable to move the first engagement mechanism in a longitudinal direction, and a first linear actuator coupled between the base and the first cross-slide operable to selectively and independently translate the first cross-slide longitudinally with respect to the base; the second engagement mechanism further comprises a second cross-slide movably carried upon the base operable to move the second engagement mechanism in a longitudinal direction, and a second linear actuator coupled between the base and the second cross-slide operable to selectively and independently translate the second cross-slide longitudinally with respect to the base; the connection system further comprises a control system coupled to the base actuator assembly and the first and second linear actuators for selectively and independently controlling the base actuator assembly and the first and second linear actuators; a sealing fluid swivel assembly disposed in the coaxial tool assembly operable to communicate pressure from an interior of the inner wrench; a pressure sensing device fluidly coupled to the interior of the inner wrench via the sealing fluid swivel assembly; a control system coupled to the pressure sensing device; a tapered thread formed at a connection and of the adapter pipe; a safety cuff carried by the base and having a thread dimensioned to mate with the tapered thread of the adapter pipe; a first torque-transmitting profile formed by a head at a connection end of the inner wrench; a second torque-transmitting profile formed by a head at a connection end of the outer wrench; a clamping assembly; a tray carried by the clamping assembly, the base movably carried by the tray; the inner wrench, the outer wrench, and the adapter pipe are selectively and independently rotatable in clockwise and counterclockwise directions by the control system; the control system is coupled to the first, second, and third actuator assemblies for selectively and independently controlling the first, second, and third actuator assemblies; the base is selectively and independently movable in a transverse direction by a base actuator assembly coupled between the base and the clamping assembly; the control system is coupled to the base actuator assembly and the first and second linear actuators for selectively and independently controlling the base actuator assembly and the first and second linear actuators; a torque-transmitting profile formed by a head at a connection end of the inner wrench and dimensioned to engage and operate a pressure tap disposed within the safety plug of the continuous circulation sub, thereby being operable to establish selective fluid communication between an interior location of the continuous circulation sub and an interior of the inner wrench; a pressure sensing device fluidly coupled to the interior of the inner wrench via the sealing fluid swivel assembly, the control system coupled to the pressure sensing device; a tapered thread formed at a connection and of the adapter pipe and dimensioned for establishing a high-pressure fluid seal with the threaded side port; a torque-transmitting profile formed at a connection end of the outer wrench and dimensioned to engage and selectively rotate safety plug for extraction of the safety plug from the threaded side port and reinsertion of the safety plug into the threaded side port; a safety cuff carried by the base and having a thread dimensioned to mate with and receive the safety plug during the extraction of the safety plug from the threaded side port; a safety cuff carried by the tray and positioned so as to receive and hold the threaded safety plug when extracted by the outer wrench; the second engagement mechanism is operable to unscrew screw the adapter pipe from the threaded side port of the continuous circulation sub; the first engagement mechanism is operable to reinsert the threaded safety plug from the safety cuff into the threaded side port to effect a high-pressure threaded seal; a selectively rotatable second wrench movably carried on the tray and operable to engage, rotate, establish fluid communication with a pressure tap disposed in the safety plug; the second wrench is coaxially disposed within the first wrench; and a clamping assembly coupled to the tray and arranged for connection to the continuous circulation sub.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed:

1. A connection system to interface with a continuous circulating sub, comprising:

a threaded side port of the circulating sub, the threaded side port including a pressure tap and a safety plug disposed therein;

a movable base;

a first engagement mechanism carried on the base to include a coaxial tool assembly having a rotatable inner wrench nested inside a rotatable outer wrench, said inner wrench selectively engaging said pressure tap to fluidly couple said pressure tap to a pressure sensing device said outer wrench selectively engaging said safety plug, wherein said first engagement mechanism further comprises a first actuator assembly coupled to said inner wrench and operable to selectively rotate said inner wrench, and a second actuator assembly coupled to said outer wrench and operable to selectively rotate said outer wrench;

a second engagement mechanism mounted on the base to include a rotatable tubular adapter pipe carried on the base, wherein said second engagement mechanism further comprises a third actuator assembly coupled to said adapter pipe and operable to selectively rotate said adapter pipe; and a control system coupled to said first, second, and third actuator assemblies to selectively and independently control said first, second, and third actuator assemblies.

2. The connection system of claim 1 wherein:

(i) said first engagement mechanism is carried on said base at a fixed transverse distance from said second engagement mechanism; or (ii) said first and second engagement mechanisms are independently movable in both transverse and longitudinal directions; and said inner wrench, said outer wrench, and said adapter pipe are selectively and independently rotatable in clockwise and counterclockwise directions.

3. The connection system of claim 1 wherein:

said base is selectively and independently movable in a transverse direction by a base actuator assembly;

said first engagement mechanism further comprises a first cross-slide movably carried upon said base operable to move said first engagement mechanism in a longitudinal direction, and a first linear actuator coupled between said base and said first cross-slide operable to selectively and independently translate said first cross-slide longitudinally with respect to said base;

said second engagement mechanism further comprises a second cross-slide movably carried upon said base operable to move said second engagement mechanism in a longitudinal direction, and a second linear actuator coupled between said base and said second cross-slide operable to selectively and independently translate said second cross-slide longitudinally with respect to said base; and said connection system further comprises a control system coupled to said base actuator assembly and said first and second linear actuators to selectively and independently control said base actuator assembly and said first and second linear actuators.

4. The connection system of claim 1 further comprising:

(i) a sealing fluid swivel assembly disposed in said coaxial tool assembly operable to communicate pressure from an interior of said inner wrench;

said pressure sensing device fluidly coupled to said interior of said inner wrench via said sealing fluid swivel assembly; and a control system coupled to said pressure sensing device;

(ii) a tapered thread formed at a connection and of said adapter pipe; and a safety cuff carried by said base and having a thread dimensioned to mate with said tapered thread of said adapter pipe;

(iii) a first torque-transmitting profile formed by a head at a connection end of said inner wrench; and a second torque-transmitting profile formed by a head at a connection end of said outer wrench; or (iv) a clamping assembly; and a tray carried by said clamping assembly, said base movably carried by said tray.

5. The connection system of claim 1 wherein:

said moveable base is supported by a tray;

said first engagement mechanism is movably carried on the tray, said rotatable outer wrench is operable to extract a threaded safety plug from a threaded side port of said continuous circulation sub; and said second engagement mechanism is movably carried on the tray, said adapter pipe has threads at a connection end thereof, said second engagement mechanism is operable to screw said adapter pipe into said threaded side port of said continuous circulation sub to effect a high-pressure threaded seal.

6. The connection system of claim 5 further comprising:

(i) a safety cuff carried by said tray and positioned so as to receive and hold said threaded safety plug when extracted by said outer wrench; or (ii) a clamping assembly coupled to said tray and arranged to connect to said continuous circulation sub.

7. The connection assembly of claim 5 wherein:

(i) said second engagement mechanism is operable to unscrew screw said adapter pipe from said threaded side port of said continuous circulation sub; and said first engagement mechanism is operable to reinsert said threaded safety plug from said safety cuff into said threaded side port to effect a high-pressure threaded seal;

(ii) said rotatable inner wrench is movably carried on said tray and operable to engage, rotate, establish fluid communication with a pressure tap disposed in said safety plug; or (iii) said second wrench is coaxially disposed within said first wrench.

8. A continuous circulation system to drill wellbores, comprising:

a continuous circulation sub having a threaded side port formed therein and a safety plug threadedly received within said side port; and a continuous circulation sub connection assembly arranged to be positioned proximal to said side port of said continuous circulation sub, said connection assembly including a base, a first engagement mechanism movably carried on the base and including a coaxial tool assembly having a rotatable inner wrench nested inside a rotatable outer wrench, a second engagement mechanism movably carried on the base and including a rotatable tubular adapter pipe; a control system operable to selectively and independently control translation of said base and said first and second engagement mechanisms and rotation of said inner wrench, said outer wrench, and said adapter pipe, wherein said inner wrench selectively engages a pressure tap and said outer wrench selectively engages said safety plug, wherein said base is selectively and independently movable in a transverse direction by a base actuator assembly;

said first engagement mechanism further comprises a first cross-slide movably carried upon said base operable to move said first engagement mechanism in a longitudinal direction, and a first linear actuator coupled between said base and said first cross-slide operable to selectively and independently translate said first cross-slide longitudinally with respect to said base;

said second engagement mechanism further comprises a second cross-slide movably carried upon said base operable to move said second engagement mechanism in a longitudinal direction, and a second linear actuator coupled between said base and said second cross-slide operable to selectively and independently translate said second cross-slide longitudinally with respect to said base; and said control system is coupled to said base actuator assembly and said first and second linear actuators to selectively and independently control said base actuator assembly and said first and second linear actuators.

9. The continuous circulation system of claim 8 wherein:

(i) said first engagement mechanism is carried on said base at a fixed transverse distance from said second engagement mechanism;

(ii) said first and second engagement mechanisms are independently movable in both transverse and longitudinal directions by said control system; and said inner wrench, said outer wrench, and said adapter pipe are selectively and independently rotatable in clockwise and counterclockwise directions by said control system;

(iii) said first engagement mechanism further comprises a first actuator assembly coupled to said inner wrench and operable to selectively rotate said inner wrench, and a second actuator assembly coupled to said outer wrench and operable to selectively rotate said outer wrench;

said second engagement mechanism further comprises a third actuator assembly coupled to said adapter pipe and operable to selectively rotate said adapter pipe; and said control system is coupled to said first, second, and third actuator assemblies to selectively and independently control said first, second; and third actuator assemblies.

10. The continuous circulation system of claim 8 further comprising:

a torque-transmitting profile formed by a head at a connection end of said inner wrench and dimensioned to engage and operate said pressure tap disposed within said safety plug of said continuous circulation sub, thereby being operable to establish selective fluid communication between an interior location of said continuous circulation sub and an interior of said inner wrench;

a sealing fluid swivel assembly disposed in said coaxial tool assembly operable to transmit pressure from said interior of said inner wrench; and a pressure sensing device fluidly coupled to said interior of said inner wrench via said sealing fluid swivel assembly; said control system coupled to said pressure sensing device.

11. The continuous circulation system of claim 8 further comprising:

(i) a tapered thread formed at a connection and of said adapter pipe and dimensioned to establish a high-pressure fluid seal with said threaded side port;

(ii) a torque-transmitting profile formed at a connection end of said outer wrench and dimensioned to engage and selectively rotate safety plug to extract said safety plug from said threaded side port and reinsert said safety plug into said threaded side port;

(iii) a safety cuff carried by said base and having a thread dimensioned to mate with and receive said safety plug during extraction of said safety plug from said threaded side port; or (iv) a clamping assembly arranged for connection to said continuous circulation sub; and a tray carried by said clamping assembly; said base movably carried by said tray.

12. A method to conduct drilling operations, comprising:

providing a first continuous circulation sub disposed atop a drill string, said first sub including a threaded side port having a safety plug and a pressure tap therein;

flowing a fluid through an upper connector of said first sub into said drill string;

locating a connection system proximal to said threaded side port of said first sub, wherein said connection system includes an inner wrench and an outer wrench;

engaging said pressure tap in said threaded side port with said inner wrench;

engaging said safety plug in said threaded side port with said outer wrench;

screwing by said connection system an adapter pipe into said threaded side port to create a fluid-tight threaded seal between said adapter pipe and said side port;

flowing said fluid through said adapter pipe and said threaded side port into said drill string;

providing a second continuous circulation sub disposed atop a drill pipe;

connecting said drill pipe to said upper connector of said first sub;

flowing said fluid through an upper connector of said second sub into said drill string;

unscrewing by said connection system said adapter pipe from said threaded side port; and operating by said connection system said pressure tap of said first sub; and measuring by said connection system a pressure within said first sub via said pressure tap.

13. The method of claim 12, further comprising:

(i) removing by said connection system said safety plug from said threaded side port;

stowing by said connection system said safety plug while flowing said fluid through said adapter pipe and said threaded side port into said drill string;

reinstalling by said connection system said safety plug into said side port; and unscrewing by said connection system said adapter pipe from said threaded side port to create a fluid-tight threaded seal between said safety plug and said side port.

14. The method of claim 13, further comprising:

engaging by a first engagement mechanism of said connection system said safety plug; and engaging by a second engagement mechanism of said connection system said side port, said second engagement mechanism including said adapter pipe.

15. The method of claim 14, further comprising:

(i) operating by said first engagement mechanism of said connection system a pressure tap of said first sub; and measuring by said connection system a pressure within said first sub via said pressure tap; or (ii) automatically operating by said connection system said first and second engagement mechanisms to insert and extract said safety plug and said adapter pipe with respect to said threaded side port.

* * * * *